US006330869B1

(12) United States Patent
Yoshiki et al.

(10) Patent No.: US 6,330,869 B1
(45) Date of Patent: Dec. 18, 2001

(54) CONTROL DEVICE OF AN INTERNAL COMBUSTION ENGINE

(75) Inventors: Koichi Yoshiki; Keiji Tsujii, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/567,090

(22) Filed: May 8, 2000

(30) Foreign Application Priority Data

May 14, 1999 (JP) ..... 11-133973

(51) Int. Cl.[7] ..... F02D 13/02; F01L 13/00; F01L 1/34

(52) U.S. Cl. ..... 123/90.15; 123/90.16; 123/90.17; 123/90.19

(58) Field of Search ..... 123/90.15, 90.16, 123/90.17, 90.18, 90.19, 90.31

(56) References Cited

U.S. PATENT DOCUMENTS 4,876,995 * 10/1989 Otobe et al. ..... 123/90.12
4,889,085 * 12/1989 Yagi et al. ..... 123/90.12
4,962,732 * 10/1990 Inoue et al. ..... 123/90.16
5,628,286 * 5/1997 Kato et al. ..... 123/90.15
6,109,225 * 8/2000 Ogita et al. ..... 123/90.15

* cited by examiner

*Primary Examiner*—Wellun Lo
(74) *Attorney, Agent, or Firm*—Arent Fox Kintner Plotkin & Kahn, PLLC

(57) ABSTRACT

A controller for an internal combustion engine has a hydraulic valve characteristic changing mechanism for changing valve operating characteristics of suction and exhaust valves; a valve system provided with a hydraulic valve phase variable mechanism that changes the phase; a map that stores a fuel injection quantity and an ignition timing in response to the valve operating characteristics; and delay time setting means for setting a delay time required to complete changeover of the valve operating characteristics, based on operating oil properties detected from behavior of a valve phase variable mechanism, to change the map after the delay time has elapsed. Thus, a valve operating characteristic changing timing coincides with a map changing timing to thereby achieve an improved performance of the internal combustion engine.

5 Claims, 16 Drawing Sheets

CONTROL DEVICE OF AN INTERNAL COMBUSTION ENGINE

BACKGROUND OF THE INVENTION

The present invention relates to a control device of an internal combustion engine which is provided with a valve moving apparatus having a hydraulic valve characteristic changing mechanism for changing valve operation characteristic such as lift of a suction valve or an exhaust valve and a hydraulic valve phase variable mechanism for altering phase of the suction valve or the exhaust valve. According to the control device, when the valve operation characteristic is changed, a map storing control amounts for controlling combustion condition of the engine such as amount of injected fuel is changed at a timing reflecting property of a working oil such as viscosity of the working oil supplied to the valve characteristic changing mechanism.

An internal combustion engine provided with a valve moving apparatus having a hydraulic valve characteristic changing mechanism for changing valve operation characteristic by driving a suction valve and an exhaust valve with a cam for low speed of small lift and small valve opening time on a low rotational speed of the engine and with a cam for high speed of large lift and large valve opening time on a high rotational speed of the engine has been known (Japanese Patent Publication No. 2619696).

The above valve characteristic changing mechanism has connecting pins provided on respective rocker arms of the suction valve and the exhaust valve, and an oil pressure changing valve. The connecting pins are moved by pressure of oil which is changed over by the oil pressure changing valve, to connect or disconnect the rocker arms, so that the rocker arms, therefore the suction valve and the exhaust valve, are driven by the cam for low speed or the cam for high speed.

When the valve operation characteristic is changed, a map of fuel injection amount and a map of ignition time are changed into maps for low speed or maps for high speed corresponding to the valve operation characteristic, to carry out fuel injection amount control and ignition time control. In that case, a delay time required for changing actions of the valve characteristic changing mechanism of all cylinders to be completed by the oil pressure changed by the oil pressure changing valve is previously set in a timer, and change of the maps is carried out after the delay time elapses for the fuel injection amount control and the ignition time control adapted to the valve operation characteristic.

However, in the above-mentioned prior art, as the delay time to be set in the timer, a fixed value decided from a viewpoint of prevention of engine stall and prevention of deterioration of drive ability is adopted, so that the delay time does not correspond to change of property of the working oil of the valve characteristic changing mechanism. Therefore, sometimes, notwithstanding that actually valve characteristic changing mechanisms of all cylinders have been already changed into high speed side (or low speed side), maps for fuel injection amount ad ignition time remain in maps for low speed (or for high speed), because the oil property (oil viscosity susceptible to temperature, for example) is altered influenced by operational condition of the engine to alter operation response of the valve characteristic changing mechanism. And, in a short period when a suction air amount, a fuel injection amount and an ignition time are not adapted to each other due to a time lag between a valve operation characteristic changing time point and a map changing time point, air-fuel ratio or ignition time deviates from an optimum value to produce undesirable results regarding engine performance other than the prevention of engine stall and the prevention of deterioration of drive ability, especially regarding exhaust emission.

SUMMARY OF THE INVENTION

The present invention has been accomplished in view of the foregoing, and a subject of the invention is to further improve performance of the internal combustion engine by that property of the working oil in the hydraulic valve characteristic changing mechanism of the valve moving apparatus is detected, and the delay time deciding a change timing of a control amount holding means which folds control amounts for controlling combustion condition of the internal combustion engine is altered in accordance with the detected property of the working oil, to make a change of the valve operation characteristic coincide with the change of the control amount holding means.

The present invention provides a control device of an internal combustion engine, comprising an operational condition detecting means for detecting an operational condition of the internal combustion engine; a valve moving apparatus provided with a first valve control mechanism having a hydraulic valve characteristic changing mechanism for changing valve operation characteristic of at least one of a suction valve and a exhaust valve of said engine, and an oil pressure changing valve for changing pressure of a working oil supplied to said valve characteristic changing mechanism from an oil pressure source; a first valve operation control means for controlling operation of said oil pressure changing valve in accordance with the operational condition detected by said operational condition detecting means; control amount holding means corresponding to said respective valve operation characteristic which hold control amounts to control combustion condition of said engine; a combustion control means operated based on said control amount of said control amount holding means; a working oil pressure detecting means for detecting property of said working oil; a delay time setting means for setting a delay time between change of oil pressure by said oil pressure changing valve and completion of change of valve operation characteristic by said valve characteristic changing mechanism based on property of said working oil detected by said working oil property detecting means; and changing means for changing said control amount holding means to a control amount holding means corresponding to a changed valve operation characteristic when said delay time elapses after said oil pressure to be supplies to said valve characteristic changing mechanism is changed by said oil pressure changing valve.

According to this invention, after the delay time set based on property of the working oil of the valve characteristic changing mechanism elapses, the changing means changes the control amount holding means from a control amount holding means corresponding to a valve operation characteristic before the valve moving mechanism is changed to a control amount holding means corresponding to a valve operation characteristic after the valve moving mechanism is changed. And the combustion control means controls combustion of the engine based on a control amount held in the changed control amount holding means. Since the delay time can be set in accordance with change of property of the working oil which is influenced by operational condition of the engine, in a wide operation range of the engine, change timing of the valve operation characteristic and change timing of the control amount holding means can be made coincide with each other to control combustion of the engine with a control amount most suitable for the valve operation characteristic, so that performance of the engine can be more improved.

The said valve moving apparatus may further comprise a hydraulic valve phase variable mechanism for altering phase of open-close period of at least one of said suction valve and said exhaust valve, and a second valve control mechanism having an oil pressure control valve for controlling pressure of a working oil supplied to said valve phase variable mechanism from said oil pressure source. Further, operation of said oil control valve may be controlled by a second valve operation control means in accordance with the operational condition detected by said operational condition detecting means, and said working oil property detecting means may detect property of said working oil based on behavior of said second valve control mechanism.

According to this invention, the working oil property detecting means can detect working oil property in the valve characteristic changing mechanism based on behaviors of the valve phase variable mechanism operated by oil pressure and the second valve control mechanism having the oil pressure control valve. As the result, a detecting means for directly detecting property of the working oil, for example, a temperature sensor for the working oil is unnecessary and the cost is reduced. As factors exerting influence on property of the working oil, there are kind of the working oil, secular change of the working oil or the like in addition to factors based on operational condition of the engine (temperature of working oil, for example). Since the property of the working oil detected according to this invention includes all of the factors, more accurate working oil property can be detected, and therefore more accurate change timing of the control amount holding means can be set, compared with a case that the working oil property is detected only by the oil temperature sensor for example.

Phase detecting means for detecting phase of at least one of said suction valve and said exhaust valve having phase altered, and phase change speed calculating means for calculating changing speed of phase detected by said phase detecting means may be provided, and said working oil property detecting means may detect said working oil property based on said changing speed of phase.

According to this invention, property of the working oil can be detected from behavior of the valve phase variable mechanism which reflects property of the working oil. Further, since detection of the working oil property is possible even when the phase is altered largely or continuously, the working oil property can be detected one by one in a wide engine operation region.

Phase detecting means for detecting phase of at least one of said suction valve and said exhaust valve having phase altered, and target phase setting means for setting a target phase based on the operational condition detected by said operational condition detecting means may be provided, said second valve operation control means may control operation of said oil pressure control valve so that said target phase concurs with said phase detected by said phase detecting means, and said working oil property detecting means may detect working oil property based on deviation between said target phase and said phase detected by said phase detecting means.

According to this invention, property of the working oil can be detected from behavior of the valve phase variable mechanism which reflects property of the working oil. Further, since the deviation between the target phase and the actual phase is a datum obtainable in course of controlling the valve phase variable mechanism to the target phase, no particular apparatus is necessary for obtaining the deviation to detect the working oil property.

Said oil pressure control valve may be operated in accordance with an amount of supply electric current which is duty-controlled by said second valve operation control means, and said working oil property detecting means may detect working oil property based on duty ratio of said amount of supply electric current when said valve phase variable mechanism maintains a fixed phase by oil pressure controlled by said oil pressure control valve.

According to this invention, by utilizing duty ratio of the amount of electric current supplied to the oil pressure control valve for controlling pressure of the working oil supplied to the valve phase variable mechanism, even in an engine operation region where phase of the suction valve or the exhaust valve is not altered by the valve phase variable mechanism, the working oil property can be detected and the delay time can be set based thereon.

DETAILED DESCRIPTION OF PREFERRED EMBODIMENT OF THE INVENTION

Hereinafter, a preferred embodiment of the present invention will be described with reference to FIGS. 1 to 18.

Figure 1:
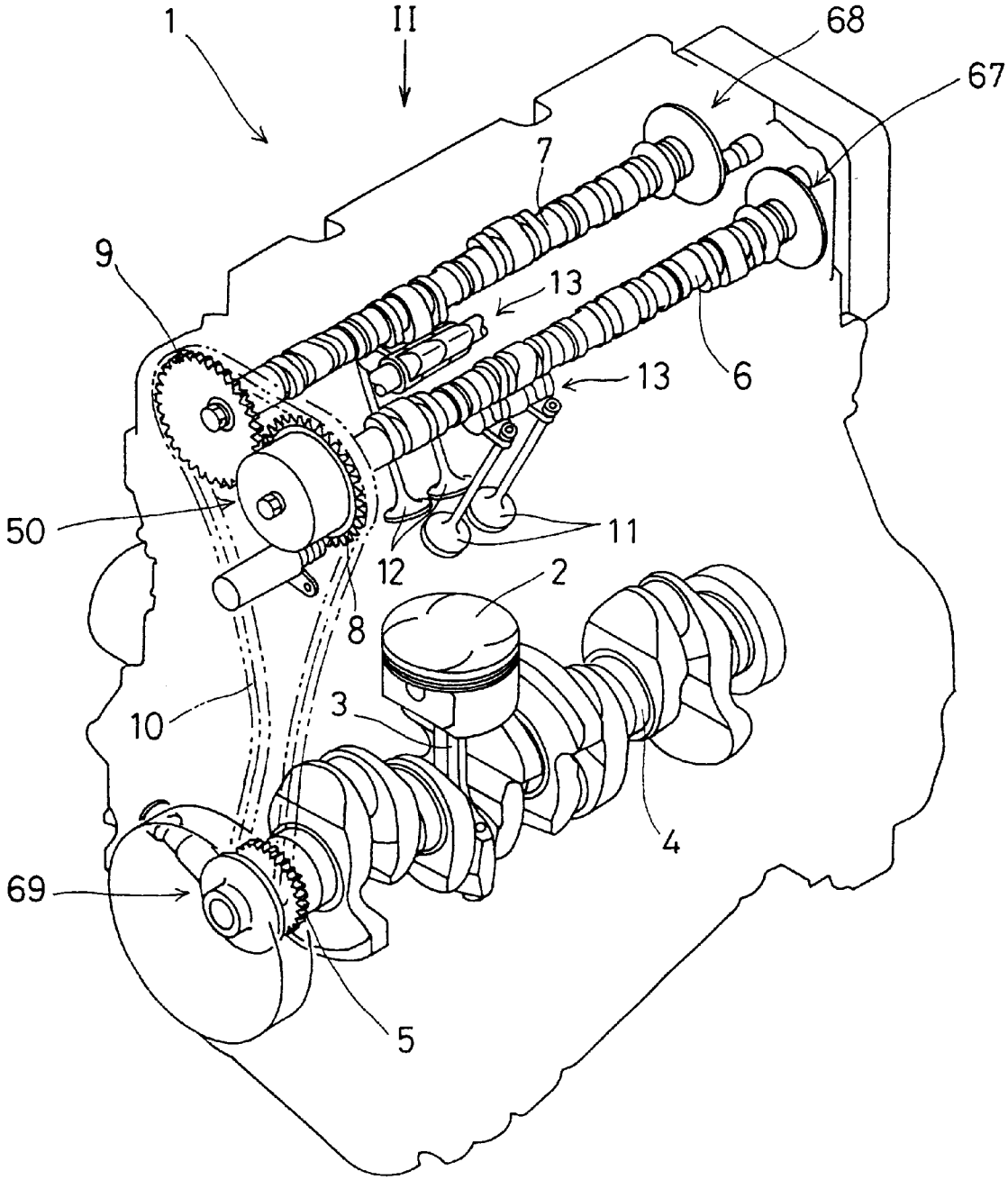
FIG. 1 is a whole view of an internal combustion engine applied the present invention.

In the embodiment shown in FIGS. 1–14, 16 and 17, the internal combustion engine 1 is a spark-ignition, 4 cylinder, DOHC 4 valve internal combustion engine to be mounted on a vehicle and has pistons 2 connected to a crankshaft 4 via connecting rods 3. As shown in FIG. 1, a drive sprocket 5 provided on one end of the crankshaft 4, a suction cam sprocket 8 provided on one end of a suction cam shaft 6 and an exhaust cam sprocket 9 provided on one end of an exhaust cam shaft 7 are connected by a timing chain 10 so that the cam shafts 6, 7 rotate once while the crankshaft 4 rotates twice.

Each cylinder has two suction valve 11 driven by the suction cam shaft 6 and two exhaust valves 12 driven by the exhaust cam shaft 7. Between the suction cam shaft 6 and the suction valve 11 and between the exhaust cam shaft 7 and the exhaust valve 12 are provided respective valve characteristic changing mechanisms 13 which change valve operation characteristics (lift and opening period, for example) of the valves 11, 12 in three modes. At the end of the suction cam shaft provided with the cam sprocket 8 is provided a valve phase variable mechanism 50 which advances or retards opening-closing period of the suction valve 11 continuously to alter cam phase.

Both the valve characteristic changing mechanisms 13 for the suction valve 11 and the exhaust valve 12 are of the same construction. Therefore, the valve characteristic changing mechanism 13 for the suction valve 11 will be described hereinafter referring to FIGS. 2 to 5.

For every cylinder, the suction valve 11 is integrally provided with a cam for low speed 15, a cam for high speed 16 and an upheaved portion 17 which are arranged in this order. Under the suction cam shaft 6 is fixed a rocker shaft 18 in parallel with the cam shaft 6, and a first rocker arm 19, a second rocker arm 20 and a third rocker arm 21, corresponding to the cam for low speed 15, the cam for high speed 16 and the upheaved portion 17 respectively, are supported on the rocker shaft 18 so as to rock.

Figure 3:
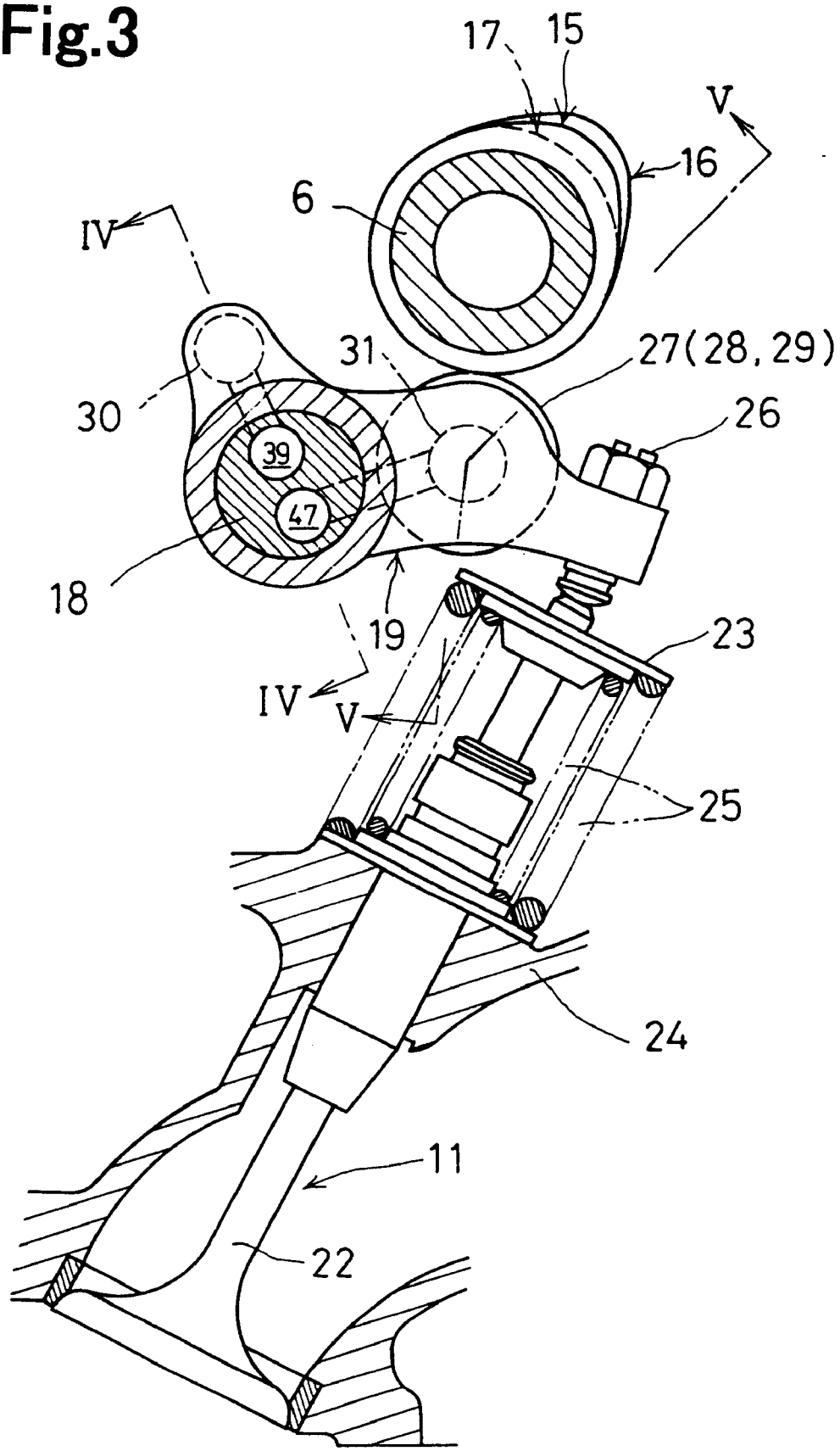
FIG. 3 is a sectional view taken along the line III—III of FIG. 2.

As shown in FIG. 3, the cam for low speed 15 has a nose part which projects radially of the suction cam shaft 6 with a relatively small projection and extends over a relatively small circumferential range, and a base circle part. The cam for high speed 16 has a nose part with a larger projection and a larger circumferential length compared with the cam for low speed 15, and a base circle part. The upheaved portion 17 has a projecting part slightly projecting radially of the suction cam shaft 6 and a base circle part. The projecting part of the upheaved portion 17 is considerably lower than the nose part of the cam for low speed 15.

A flange 23 is provided on an upper end of a valve stem 22 of the suction valve 11. The suction valve 11 is forced to close by a valve spring 25 inserted between a cylinder head 24 and the flange 23 in a compressed state. Each of the first and third rocker arms 19, 21 supported by the rocker shaft 18 so as to rock has an end adjustably provided with a tappet screw 26 which touches to an upper end of the valve stem 22 of the suction valve 11.

The first, second and third rocker arms 19, 20, 21 have respective first, second and third rollers 27, 28, 29 at a position between the rocker arm 18 and the suction valve 11. The rocker arms 19, 20, 21 rock guided by the cams 15, 16 and the upheaved portion 17 through the rollers 27, 28, 29, respectively. The second rocker arm 20 is forced by a spring means (not shown) so that the second roller 28 touches to the cam for high speed 16.

Figure 5:
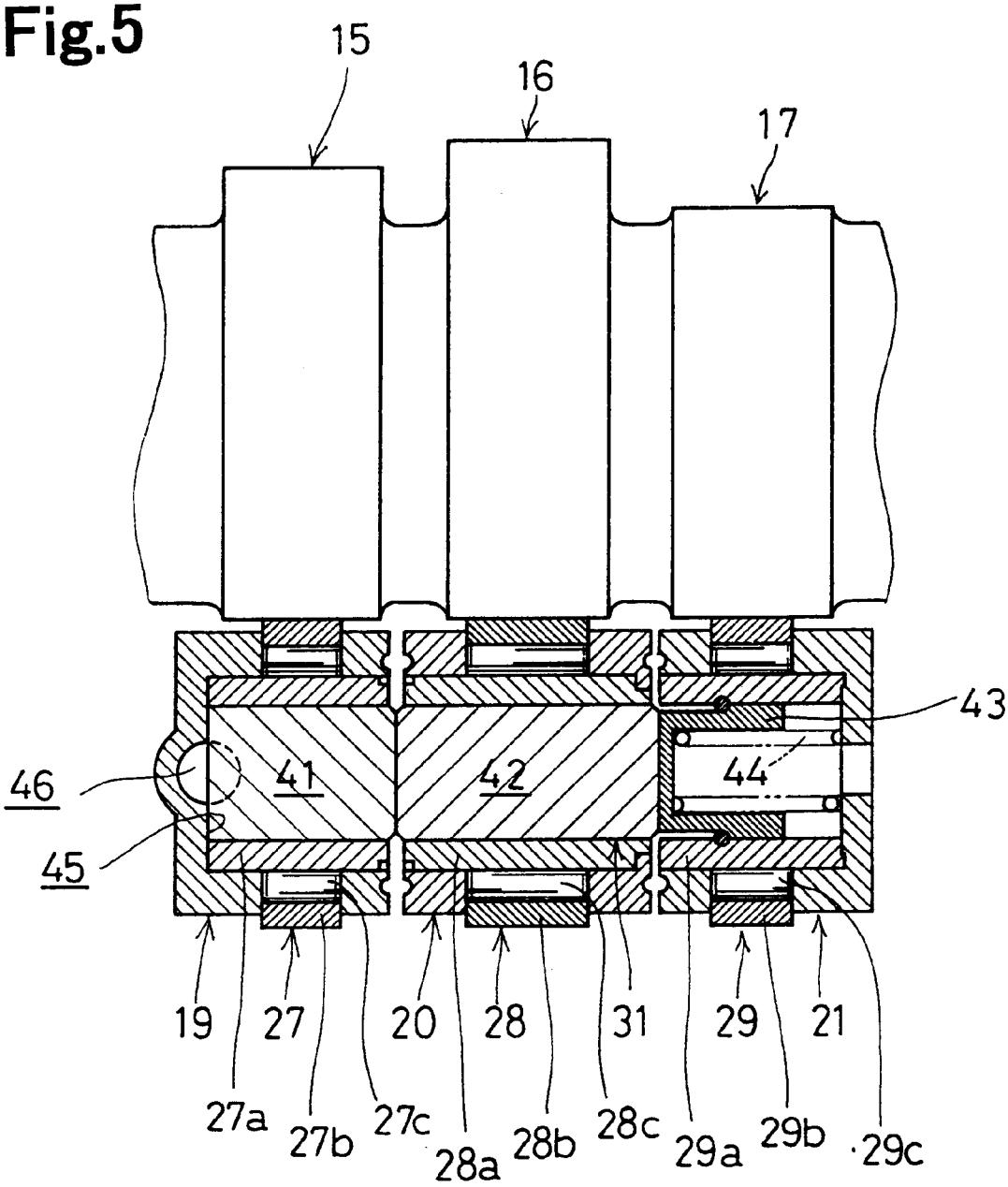
FIG. 5 is a sectional view taken along the line V—V of FIG. 3.

As shown in FIG. 5, the first roller 27 has an axis parallel with the rocker shaft 18 and comprises an inner ring 27*a* fixedly fitted to the first rocker arm 19, an outer ring 27*b* slidingly contacted with the cam for low speed 15, and a plurality of needle rollers provided between the inner ring 27*a* and the outer ring 27*b*. Similarly, the second roller 28 has an axis parallel with the rocker shaft 18 and comprises an inner ring 28*a* fixedly fitted to the second rocker arm 20, an outer ring 28*b* slidingly contacted with the cam for high speed 16, and a plurality of needle rollers 28*c* provided between the inner ring 28*a* and the outer ring 28*b*. The third roller 29 has an axis parallel with the rocker shaft 18 and comprises an inner ring 29*a* fixedly fitted to the third rocker arm 21, an outer ring 29*b* slidingly contacted with the upheaved portion 17, and a plurality of needle rollers 29*c* provided between the inner ring 29*a* and the outer ring 29*b*. When the rocker arms 19, 20, 21 are stationary, the inner rings 27*a*, 28*a*, 29*a* are fixed so as to align with each other.

Figure 4:
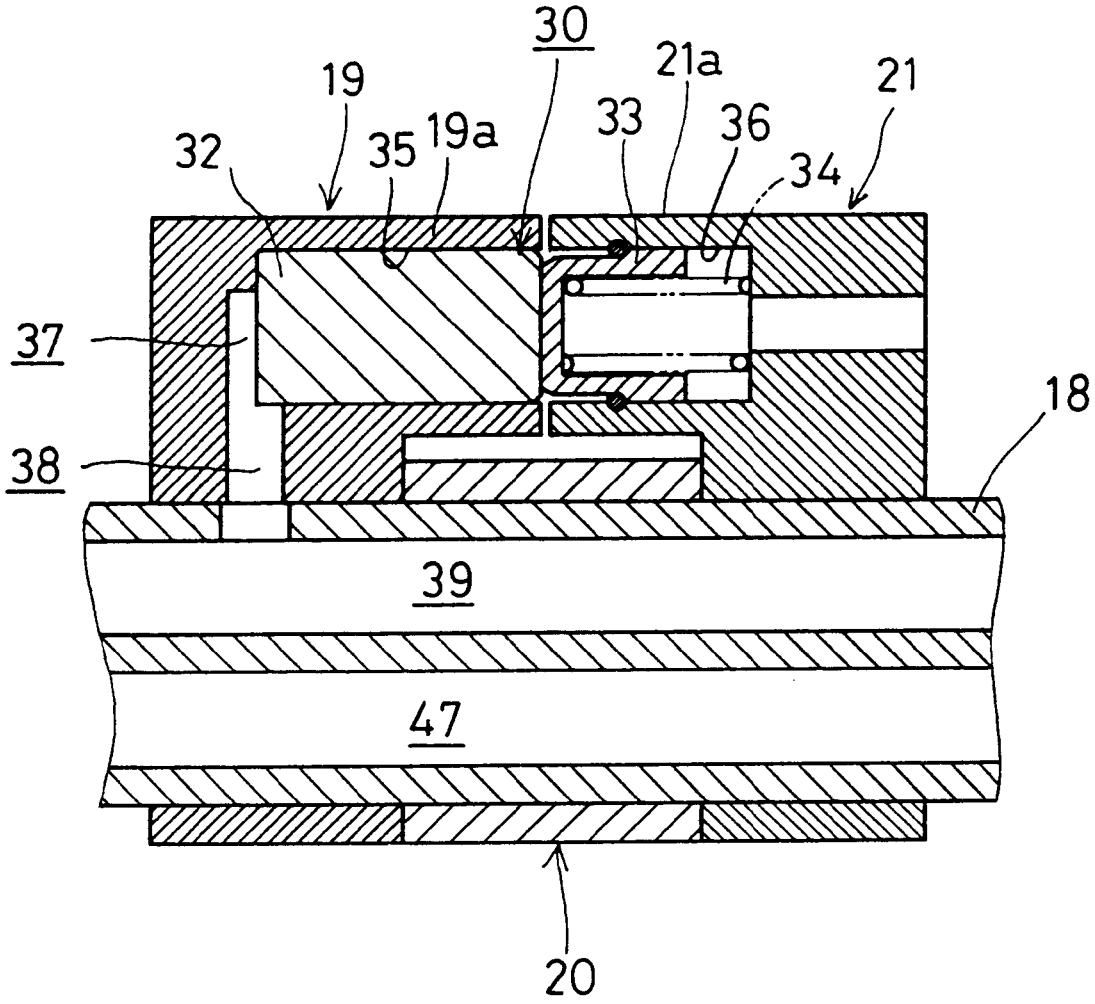
FIG. 4 is a sectional view taken along the line IV—IV of FIG. 3.

As shown in FIGS. 3 to 5, the first and third rocker arms 19, 21 are provided with a first connection changing mechanism 30 capable of connecting and disconnecting the rocker arms 19, 21, and the first, second and third rocker arms 19, 20, 21 are provided with a second connection changing mechanism 31 capable of connecting and disconnecting these rocker arms 19, 20, 21.

Namely, the first and third rocker arms 19. 21 have respective connecting arms 19*a*, 21*a* formed integrally on a side opposite to the rocker shaft 18. The connecting arms 19*a*, 21*a* are opposite to each other striding across the second rocker arm 20 and between the connecting arms 19*a*, 21*a* is provided the first connection changing mechanism 30 which comprises a connecting piston 32 capable of connecting the connecting arms 19*a*, 21*a*, a regulating member 33 for regulating movement of the connecting piston 32, and a return spring 34 for forcing the connecting piston 32 and the regulating member 33 to the disconnecting side. The connecting arms 19*a*, 21*a* have guide holes 35, 36 which are opposite to each other and extend parallel with the rocker shaft 18.

The connecting piston 32 is fitted to the guide hole 35 slidingly, and between the connecting piston 32 and a closed end of the guide hole 35 is formed a first oil pressure chamber 37. The first rocker arm 18 is provided with a communication passage 38 communicating with the first oil pressure chamber 37 and within the rocker shaft 18 is formed a first oil pressure supply passage 39 communicating with an oil pump 70. The first oil pressure supply passage 39 always communicates with the first oil pressure chamber 37 through the communication passage 38 regardless of rocking state of the first rocker arm 19.

On the one hand, the second connection changing mechanism 31 comprises a connecting piston 41 capable of connecting the first and second rocker arms 19, 20, a connecting pin 42 capable of connecting the second and third rocker arms 20, 21, a regulating member 43 for regulating movements of the connecting piston 41 and the connecting pin 42, and a return spring for forcing the connecting piston 41, the connecting pin 42 and the regulating member 43 to the disconnecting side.

The connecting piston 41 is slidingly fitted to the inner ring 27*a* of the first roller 27 and between one end of the connecting piston 41 and the first rocker arm 19 is formed a second oil pressure chamber 45. The first rocker arm 19 has a communication passage 46 communicating with second oil pressure chamber 45. Within the rocker shaft 18 is formed a second oil pressure supply passage 47 communicating with the oil pump 70. The second oil pressure supply passage 47 is isolated from the first oil pressure supply passage 39 of the first connection changing mechanism 30. The second oil pressure supply passage 47 always communicates with the second oil pressure chamber 45 through the communication passage 46 regardless of rocking state of the first rocker arm 19.

The connecting pin 42 having an end touching another end of the connecting pin 41 is slidingly fitted to the inner ring of the second roller 28. The bottomed-cylinder-like regulating member 43 touching another end of the connecting pin 42 is slidingly fitted to the inner ring 29*a* of the third roller 29. The return spring 44 is inserted between the third rocker arm 21 and the regulating member 43 in a compressed state.

In the first connection changing mechanism 30, when pressure of the working oil supplied to the first oil pressure chamber 37 is lowered, the connecting piston 32 and the regulating member 33 is moved by the return spring 34 to the disconnecting side. In this state, the contacting surface of the connecting piston 32 and the regulating member 33 positions between the first rocker arm 19 and the third rocker arm 21, and the first and third rocker arms are disconnected. When the working oil of high pressure is supplied to the first oil pressure chamber 37, the connecting piston 32 moves against the return spring 34 to the connecting side and goes into the guide hole 26 so that the first and third rocker arms 19, 21 are integrally connected.

In the second connection changing mechanism 31, when pressure of the working oil supplied to the second oil pressure chamber 45 is lowered, the connecting piston 41, the connecting pin 43 and the regulating member 43 are moved by the return spring 44 to the disconnecting side. In this state, the contacting surface of the connecting piston 41 and the connecting pin 42 positions between the first rocker arm 19 and the second rocker arm 20, the contacting surface of the connecting pin 42 and the regulating member 43 positions between the second rocker arm 20 and the third rocker arm 21, and the first, second and third rocker arms 19, 20, 21 is in a disconnected state. When the working oil of high pressure is supplied to the second oil pressure chamber 45, the connecting piston 41, the connecting pin 42 and the regulating member 43 move against the return spring 44 to the connecting to the connecting side, and the connecting pistons 41, 42 go into the inner rings 28*a*, 29*a* so that the first, second and third rocker arms 19, 20 21 are integrally connected.

Figure 2:
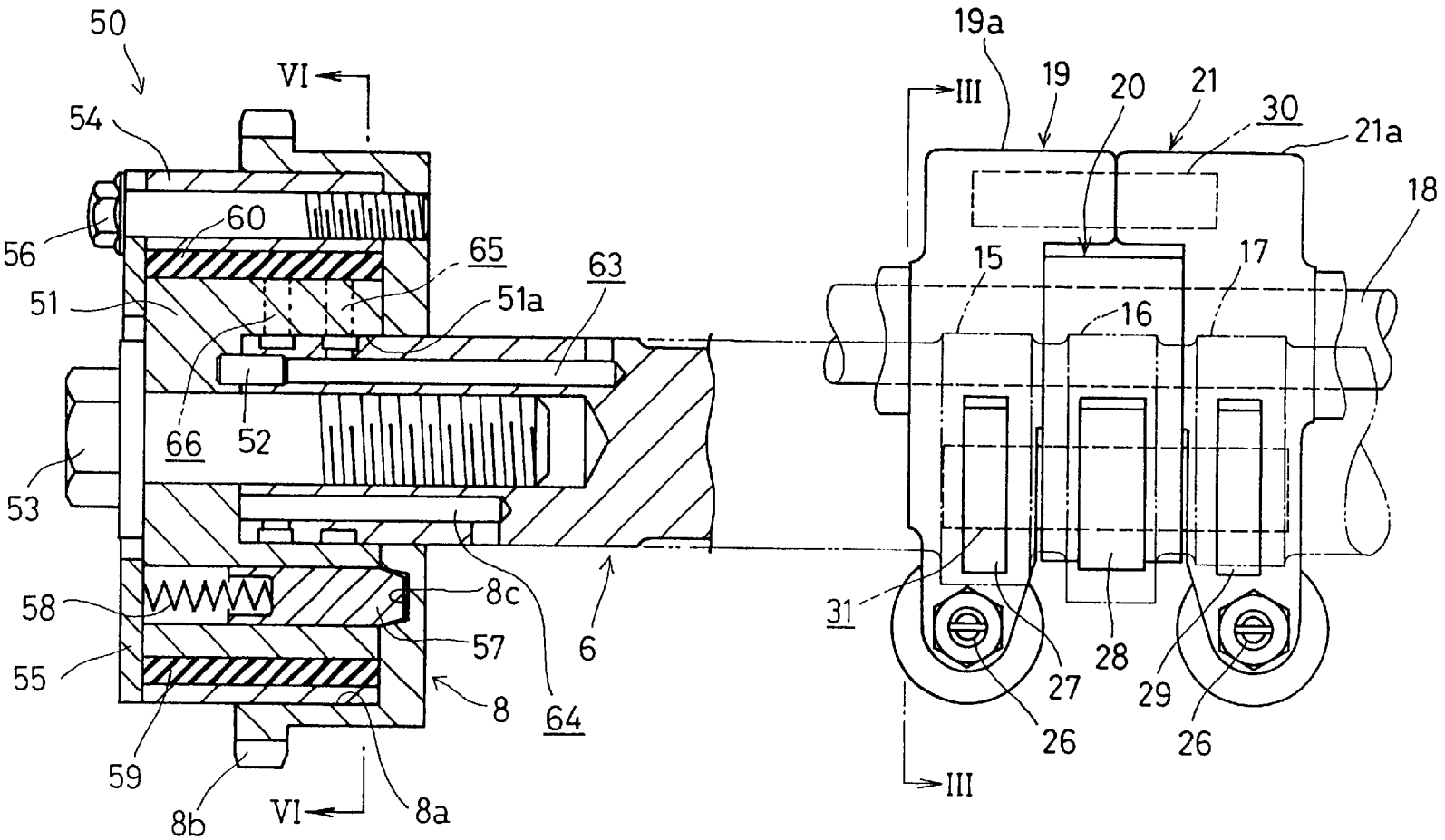
FIG. 2 is a partial view of FIG. 1 viewed in the direction of the arrow II.

Next, the valve phase variable mechanism 50 provided at an end of the suction cam shaft 6 will be described with reference to FIGS. 2 and 6.

A supporting hole 51*a* formed at a center of a cylindrical boss member 51 is coaxially fitted and connected by a pin 52 and a bolt 53 to an end portion of the suction cam shaft 6 so as not to rotate relatively. The cam sprocket 8 which the timing chain 10 is wound round is formed in a cup-shape having a circular hollow 8*a* and on its outer periphery is formed sprocket teeth 8*b*. An annular housing 54 fitted to the hollow 8*a* of the cam sprocket and a plate 55 laid on an axial end of the housing 54 are connected to the cam sprocket 8 by four bolts 56 penetrating them.

Therefore, the boss member 51 integrally connected to the suction cam shaft 6 is housed in a space surrounded by the cam sprocket 8, the housing 54 and the plate 55 so as to rotate. A lock pin 57 is slidingly fitted to a pin hole axially penetrating the boss member 51. The lock pin 57 is forced by a compressed spring 58 inserted between the lock pin 57 and the plate 55 so as to engage with a lock hole 8*c* formed in the cam sprocket 8.

Within the housing 54 are formed four fan-shaped hollows 54*a* arranged about axis of the suction cam shaft 6 at intervals of 90 degrees. Four vanes 51*b* radially projecting from an outer periphery of the boss member 51 are fitted into the hollows 54*a* so as to rotate in an angular range of 30 degrees. Seal members 59 provided at tip ends of the vanes 51*b* slidingly touch top walls of the hollows 54*b* and seal members 60 provided on an inner peripheral surface of the housing 54 slidingly touch an outer peripheral surface of the boss member 51, so that an advance chamber 61 and a retard chamber 62 are partitioned on both sides of the each vane 51*b*.

Within the suction cam shaft 6 are formed an oil passage for advance 63 and an oil passage for retard 64. The oil passage for advance 63 communicates with the four advance chambers 61 through four oil passages 65 radially penetrating the boss member 51, and the oil passage for retard 64 communicates with the four retard chambers 62 through four oil passages 66 radially penetrating the boss member 51. The lock hole 8*c* of the cam sprocket 8 engaging with the lock pin 57 communicates with any one of the advance chamber 61 through an oil passage (not shown).

Figure 6:
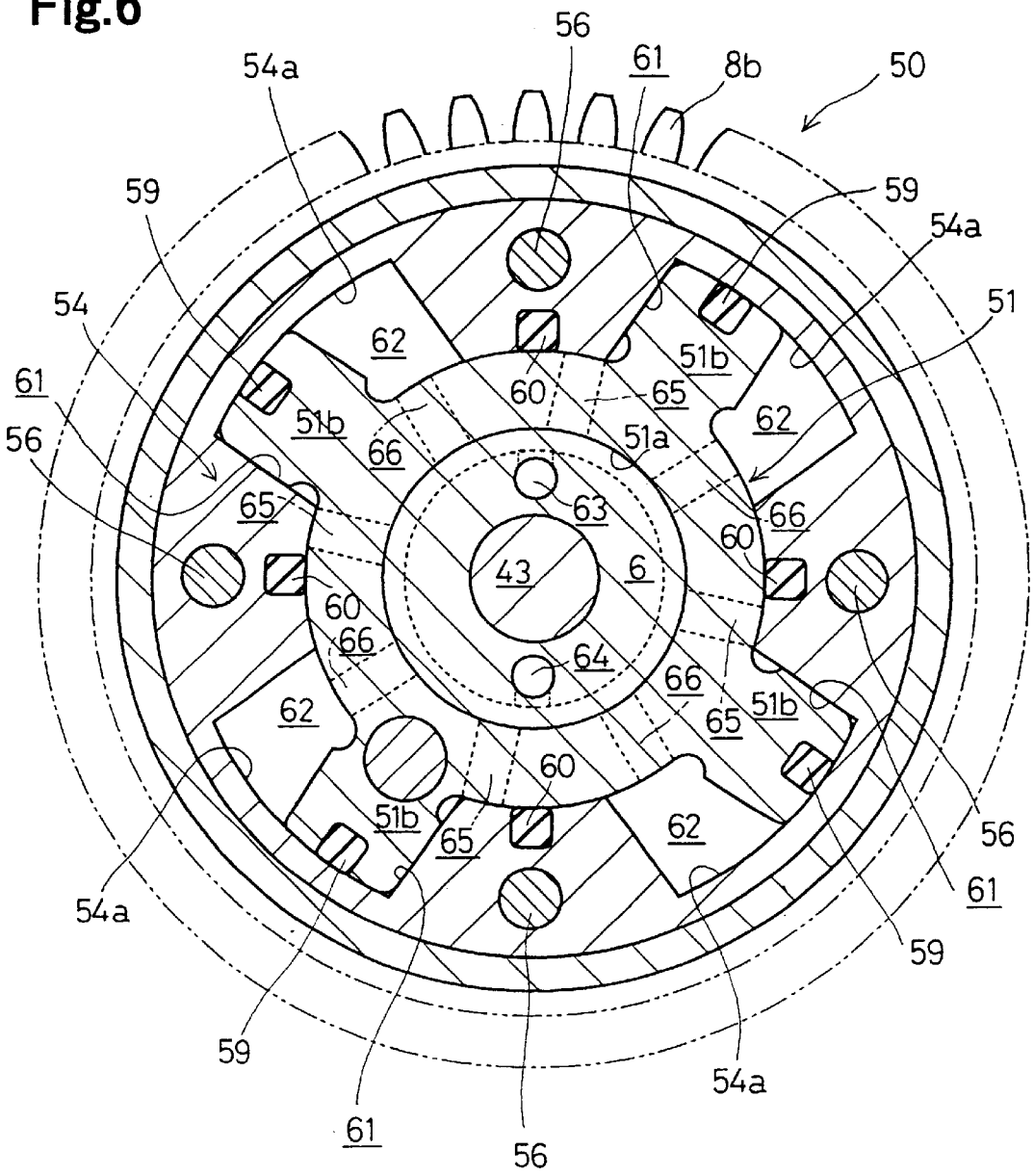
FIG. 6 is a sectional view taken along the line VI—VI of FIG. 2.

When the working oil is not supplied to the advance chamber 61, a head part of the lock pin 57 is fitted into the lock hole 8*c* of the cam sprocket 8 by force of the spring 58 and the cam shaft 6 is locked to the cam sprocket 8 in a most retarded state that the cam shaft 6 is extremely rotated anticlockwise relatively to the cam sprocket 8 as shown in FIG. 6. When pressure of the working oil supplied to the advance chamber 61 is raised from the above state, the lock pin 57 leave the lock hole 8*c* of the cam sprocket 8 against the force of the spring 58 by the pressure of the working oil supplied from the advance chamber 61, the vane 51*b* is rotated clockwise relatively to the cam sprocket 8 by pressure difference between the advance chamber 61 and the retard chamber 62, and phases of the cam for low speed 15 and the cam for high speed 16 are advanced all at once to alter the valve opening period and the valve closing period of the suction valve 11 toward advance side. Therefore, the opening-closing period of the suction valve 11 can be altered continuously by controlling oil pressure in the advance chamber 61 and the retard chamber 62.

Figure 7:
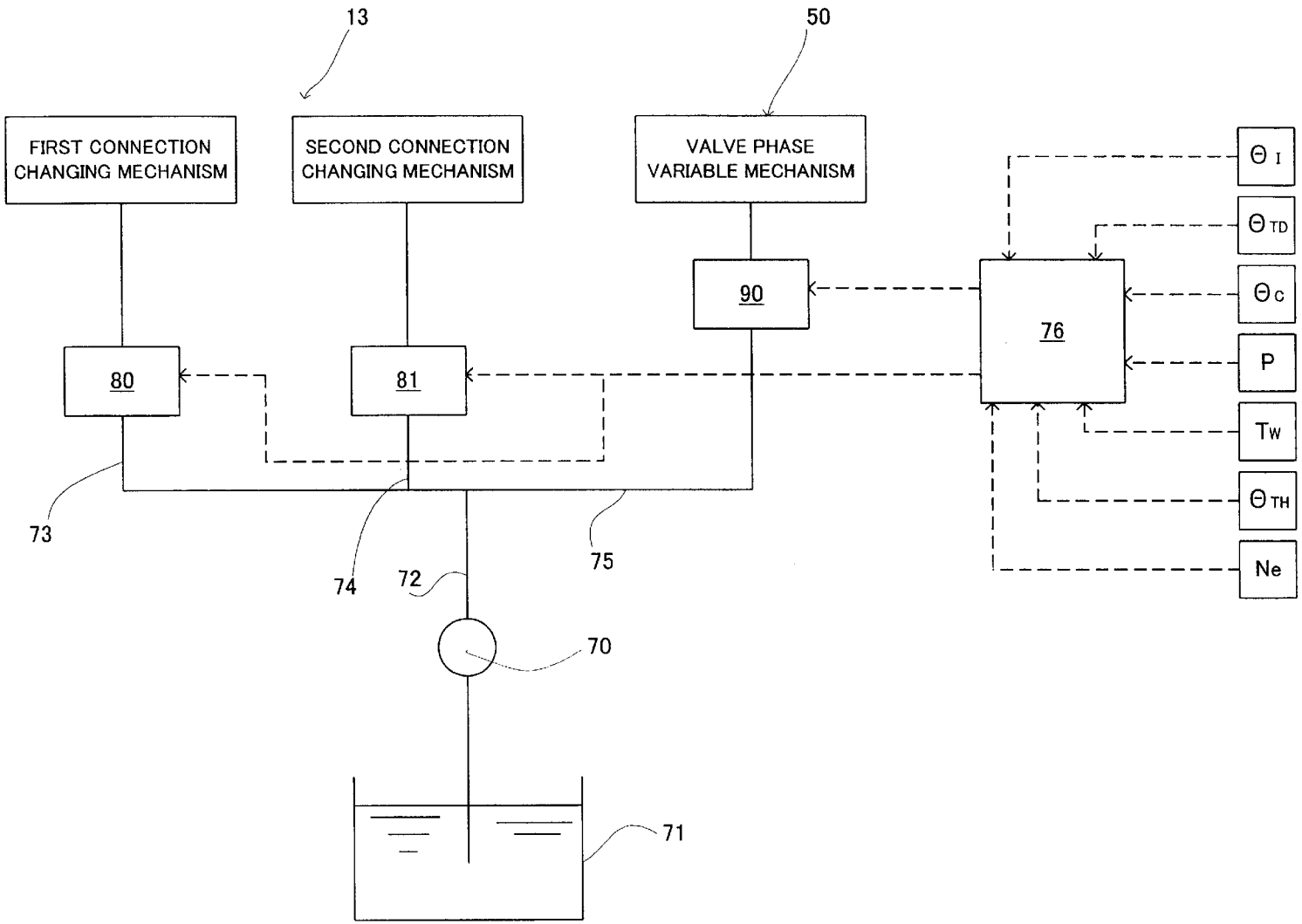
FIG. 7 is an oil pressure circuit diagram of the valve characteristic changing mechanism and the valve phase variable mechanism.

An oil pressure control system for the valve characteristic changing mechanism 13 and the valve phase variable mechanism 50 will be described with reference to FIG. 7.

Oil pumped up by the oil pump to, which is the oil pressure source, from an oil pan 71 at a bottom of the crankcase is discharged into an oil passage 72 as lubricating oils of the crankshaft 4 and the valve moving mechanism of the engine 1 and as working oils of the valve characteristic changing mechanism 13 and the valve phase variable mechanism 50. In two oil passages 73, 74 branching from the oil passage 72 to communicate with the valve characteristic changing mechanism 13 of suction valve 11 side, a first oil pressure responsive valve 80 and a second oil pressure responsive valve 81 ae provided, respectively. The oil pressure responsive valves 80, 81 are examples of oil pressure changing valves for changing oil pressure of the oil pressure supply passages 39, 47 in the rocker shaft 8 into high or low. Though it is not shown, similar oil pressure changing valves are provided in oil passages communicating with the valve characteristic changing mechanism 13 of the exhaust valve 12 side, too. The valve characteristic changing mechanism 13 and the oil pressure changing valve constitute respective valve control mechanisms of the suction valve 11 side and the exhaust valve 12 side. In an oil passage 75 branching from the oil passage 72 to communicate with the valve phase variable mechanism 50 is provided a linear solenoid valve 90 which is an example of the oil pressure control valve for controlling pressures in the advance chamber 61 and the retard chamber 62 continuously. The valve phase variable mechanism 50 and the oil pressure control valve constitute a valve control mechanism other than the above-mentioned valve control mechanism.

A signal from a suction cam shaft sensor 67 (FIG. 1) detecting rotational position θI of the suction cam shaft 6, a signal from a TDC sensor detecting top dead center θTD of the piston based on a exhaust cam shaft sensor 68 (FIG. 1) which detects rotational position of the exhaust cam shaft 7, a signal of a crankshaft sensor 69 (FIG. 1) detecting rotational position θC of the crankshaft 4, a signal from a suction negative pressure sensor detecting suction negative pressure P, a signal from a cooling water temperature sensor detecting cooling water temperature TW, a signal from a throttle opening degree sensor detecting throttle opening degree θTH, and a signal from a rotational speed sensor detecting rotational speed Ne of the engine 1 are inputted in a electronic control unit 76 which is an example of control means. The electronic control unit 76 includes valve operation control means for controlling operations of the valve phase variable mechanism 50 and oil pressure responsive valves 80, 81, and valve operation control means for controlling operation of the linear solenoid valve 90. The above sensors constitute operational condition detecting means for detecting operational condition of the engine.

In a memory provided in the electronic control unit 76 are stored maps of fuel supply amount, ignition period and target cam phase having suction negative pressure and engine rotational speed as parameters. As for the fuel supply amount map (fuel injection amount map, for example) and the ignition period map, maps for low speed, middle speed and high speed are prepared corresponding to valve operation characteristics on low speed, middle speed and high speed. The fuel supply amount and the ignition period ae control amounts for controlling combustion condition of the engine 1 and the maps of the fuel supply amount and the ignition period stored In the memory of the electronic control unit 96 are examples of control amount holding means. A fuel supply apparatus for supplying fuel to the cylinder of the engine such as a fuel injection valve and an ignition period control apparatus are examples of combustion control means and these apparatus are operated based on control amounts stored in the maps.

Figure 8:
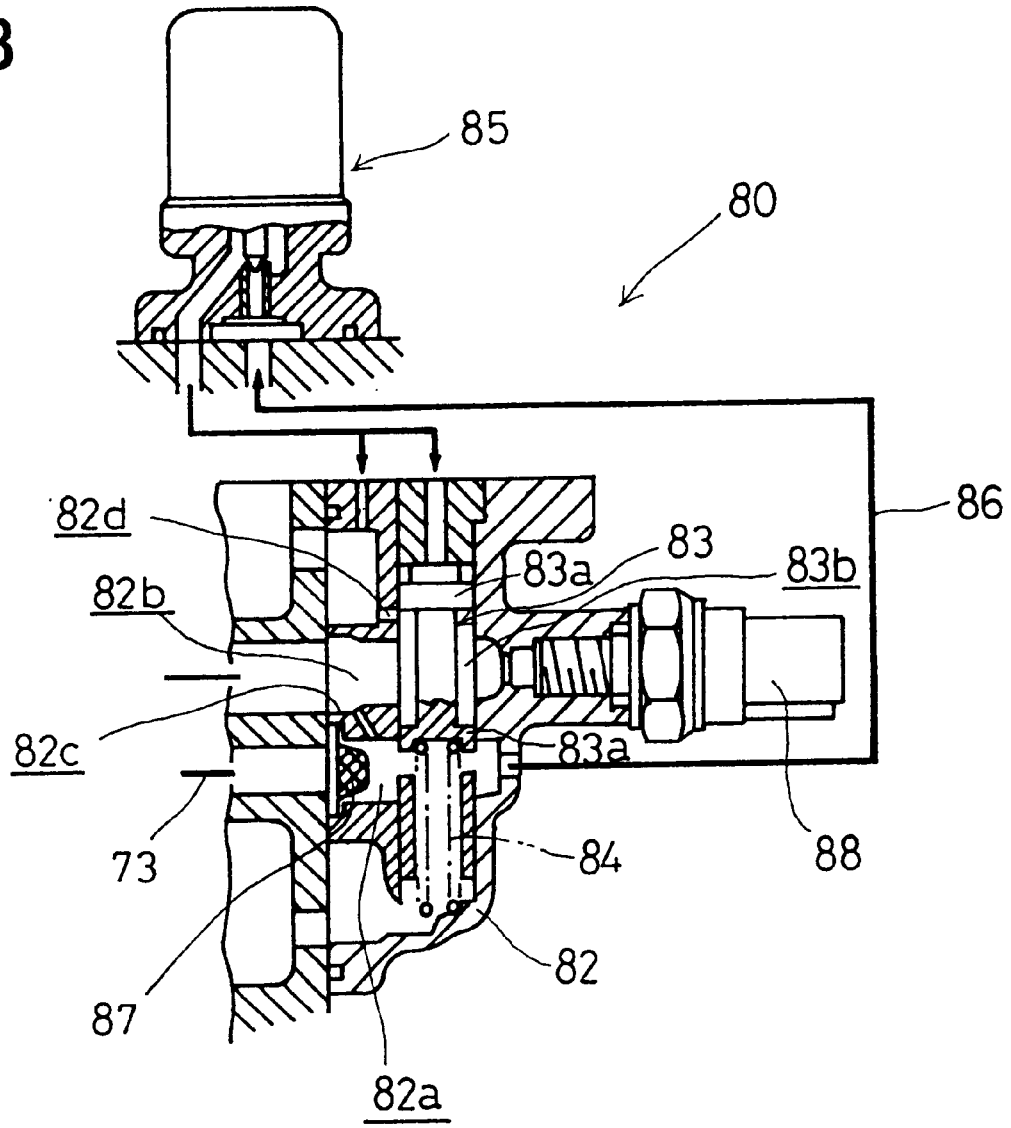
FIG. 8 is a sectional view of an oil pressure corresponding valve.

Referring to FIG. 8, the first oil pressure responsive valve 80 comprises a housing 82, a spool 83 slidingly fitted in the housing 82, a spring 84 forcing the spool 83 in a direction to close the valve, and a first solenoid valve 85 of normally closed type operated by instructions from the valve operation control means of the electronic control unit 76. The spool 83 is moved to an open position against force of the spring 84 by pilot pressure inputted through a pilot oil passage 86 branched from a inlet port 82*a* formed in the housing 82. The pilot oil passage 86 is opened and closed by the first solenoid valve 85, and when the first solenoid valve 85 is opened, the spool 83 moves to the open position.

The housing 82 is formed with an inlet port 82*a* communicating with the oil passage 73 through an oil filter 87, an outlet port 82*b* communicating with the first oil pressure supply passage 39, an orifice 82*c* communicating with the inlet port 82*a* and the outlet port 82*b*, and a drain port 82*d* communicating with the outlet port 82*b* and opening to an upper space of the cylinder head 24. The spool 83 has a groove 83*b* between a pair of lands 83*a*.

When the spool 83 is in the close position, the outlet port 82*b* communicates with the inlet port 82*a* through only the orifice 82*c* and also communicates with the drain port 82*d*, so that pressure of the work oil in the first oil pressure supply passage 39 becomes low. When the spool 83 is in the open position, the outlet port 82*b* communicates with the inlet port 82*a* through the groove 83*b* and is disconnected from the drain port 82*d*, so that pressure of the working oil in the first oil pressure supply passage 39 becomes high.

The housing 82 is provided with a first oil pressure switch 88 to confirm opening-closing motion of the spool 83 which detects oil pressure of the outlet port 82*b* and turns on or off when the oil pressure is low or high.

Oil pressure of the second oil pressure supply passage 74 is also changed by the second oil pressure responsive valve 81 which has the same construction as the first oil pressure responsive valve 80. Also on the side of the exhaust valve 12 are provided first and second oil pressure responsive valves 80, 81 of the same construction as those on the suction valve 11 side.

Figure 9:
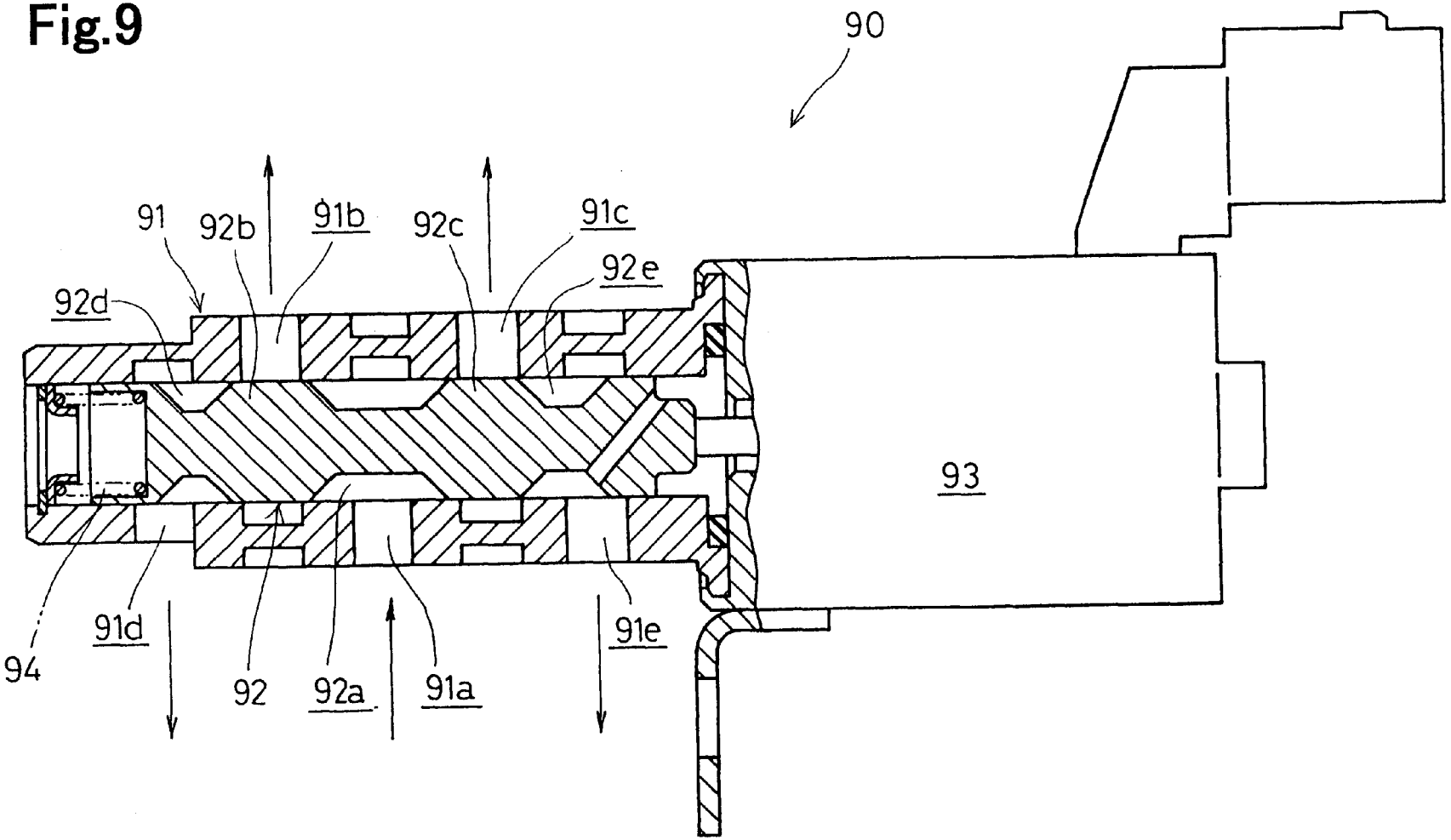
FIG. 9 is a sectional view of a linear solenoid valve.

Referring to FIG. 9, the linear solenoid valve 90 is provided with a cylindrical sleeve 91, a spool 92 slidingly fitted into the sleeve 91, a duty solenoid 93 fixed to the sleeve 91 to drive the spool 92, and a spring 94 forcing the spool 92 toward the duty solenoid 93. Electric current supplied to the duty solenoid 93 is duty controlled with ON duty by instruction from valve operation control means in the electronic control unit 76, so that an axial position of the spool 92 can be altered continuously against the spring 94.

The sleeve 91 has a central inlet port 91*a*, an advance port 91*b* and a retard port 91*c* positioned on both sides of the inlet port 91*a* respectively, and drain ports 91*d*, 91*e* positioned outside of the ports 91*b*, 91*c* respectively. On the other hand, the spool 92 has a central groove 92*a*, lands 92*b*, 92*c* positioned on both sides of the groove 92*a* respectively, and grooves 92*d*, 92*e* positioned outsides of the lands 92*b*, 92*c* respectively. The inlet port 91*a* is connected with the oil pump 70, the advance port 91*b* is connected with the advance chamber 61 of the valve phase variable mechanism 50, and the retard port 91*c* is connected with the retard chamber 62 of the valve phase variable mechanism 50.

When the engine 1 is rotated at a low speed, if the first solenoid valve 85 and the second solenoid valve close in accordance with instruction from the valve operation control means of the electronic control unit 76 to close the first and second oil pressure responsive valves 80, 81 and oil pressure supplied to the first and second connection changing mechanisms 30, 31 become low, oil pressures of the first and second oil pressure chambers 37, 45 communicating with the first and second oil pressure supply passages 39, 47 in the rocker shaft 18 become low. Therefore, the connecting piston 32 and the regulating member 33 of the first connection changing mechanism 30 are moved to the disconnecting position (FIG. 4) by the return spring 34, and the connecting piston 41, the connecting pin 42 and the regulating member 43 of the second connection changing mechanism 31 are moved to the disconnecting position (FIG. 5) by the return spring 44. As a result, the first, second and third rocker arms 19, 20, 21 are disconnected from each other, one of the suction valves 11 is opened and closed by the first rocker arm 19 with the first roller 27 touching the cam for low speed 15, and another suction valve 11 is substantially closed by the third rocker arm 21 with the third roller 29 touching the upheaved portion 17. At that time, the second rocker arm 20 with the second roller 28 touching the cam for high speed 16 runs idle regardless of operation of the suction valve 11.

When the engine 1 is rotated at a middle speed, the first solenoid valve 85 is opened in accordance with an instruction from the valve operation control means of the electronic control unit 76, the first oil pressure responsive valve 80 is opened, and pressure of the working oil supplied to the first connection changing mechanism 30 of the valve characteristic changing mechanism 13 becomes high. Therefore, oil pressure of the first oil pressure chamber 37 communicates with the first oil pressure supply passage 39 in the rocker shaft 18 becomes high, and the connecting piston 32 and the regulating member 33 is moved to the connecting position against the return spring 34. On the one hand, the second connection changing mechanism 31 is in the disconnecting position. As the result, the first and third rocker arms 19, 21 are connected to each other and rocking motion of the first rocker arm 19 with the first roller 27 touching the cam for low speed 15 is transmitted to the third rocker arm 21 connected to the first rocker arm so that both the suction valves 11 are driven to open and close. At that time, the third roller 29 of the third rocker arm 21 is distant from the upheaved portion 17, and the second rocker arm 20 runs idle regardless of operation of the suction valve 11.

When the engine 1 is rotated at a high speed, the first solenoid valve 85 and a second solenoid valve are opened in accordance with an instruction from the electronic control unit 76, the first and second oil pressure responsive valves 80, 81 are opened and pressures of the working oils supplied to the first and second connection changing mechanisms 30, 31 of the valve characteristic changing mechanism 13 become high. Therefore, oil pressures transmitted to the first and second oil pressure chambers 37, 45 from the first and second oil pressure supply passages 39, 47 in the rocker shaft 18 become high. As the result, the connecting piston 32 and the regulating member 33 of the first connection changing mechanism 30 remain in the connecting position, on the one hand the connecting piston 41, the connecting pin 42 and the regulating member 43 move to the connecting position against the return spring 44, and the first, second and third rocker arms 19, 20, 21 are integrally connected, so that rocking motion of the second rocker arm 20 with the second roller 28 touching the cam for high speed 16 is transmitted to the first and third rocker arms 19, 21 integrally connected to the second rocker arm 20, and the two suction valves 11 are driven so as to open and close. At that time, the cam for low speed 15 runs idle being distant from the first roller 27 of the first rocker arm 19 and the upheaved portion 17 runs idle being distant from the third roller 29 of the third rocker arm 21.

Thus, on the low speed rotation of the engine 1, one of the suction valves 11 is driven at a small lift and a small opening period, and another suction valve 11 is In substantially closed resting state. On the middle rotation of the engine 1, both the suction valves 11 can be driven at the small lift and the small opening period. On the high rotation of the engine 1, both the suction valves 11 can be driven at a large lift and a large opening period.

The above is the same with respect to the valve characteristic changing mechanism 13 of the exhaust valve 12 side and operation of the two exhaust valves 12, too.

Next, operation of the valve phase variable mechanism 50 will be described.

When the engine 1 is stopped, the valve phase variable mechanism 50 is kept at a most retarded state in which volume of the retard chamber 62 is largest, volume of the advance chamber 61 is zero and the lock pin 57 is fitted to the lock hole 8*c* of the cam sprocket 8. When the engine is started, the oil pump 70 operates and if oil pressure supplied to the advance chamber 61 through the linear solenoid valve 90 exceeds a predetermined value, the lock pin 57 leaves the lock hole 8*c* by the oil pressure to allow operation of the valve phase variable mechanism 50.

In this state, if duty ratio of the duty solenoid is increased from a set value corresponding to a neutral position, 50% for example, the spool 92 is moved from its neutral position shown in FIG. 9 to the left so that the inlet port 91*a* connected with the oil pump 70 communicates with the advance port 91*b* through the groove 92*a* and the retard port 91*c* communicates with the drain port 91*e* through the groove 92*e*. As the result, oil pressure acts to the advance chamber 61 of the valve phase variable mechanism 50, so that the suction cam shaft 9 rotates anticlockwise in FIG. 6 relatively to the cam sprocket 8 and cam phase of the suction cam shaft 6 alters to the advance side continuously. Then, when a target cam phase is obtained, the duty ratio of the duty solenoid 93 is set at 50% to position the spool 92 of the linear solenoid valve 90 at the neutral position as shown in FIG. 9, where the inlet port 91*a* is closed between the lands 92*b*, 92*c* and the retard port 91*c* and the advance port 91*b* are closed by the lands 92*b*, 92*c* respectively. Thus, the cam sprocket 8 and the suction cam shaft 6 are fixed relatively to maintain the cam phase constant.

In order to alter the cam phase of the suction cam shaft 6 to the retard side continuously, the duty ratio of the duty solenoid 93 is reduced from 50% to move the spool 92 to the right from the neutral position, so that the inlet port 91*a* connected with the oil pump 70 communicates with the retard port 91*c* through the groove 92*a* and the advance port 91*b* communicates with the drain port 91*d* through the groove 92*d*. When a target cam phase is obtained, the duty ratio of the duty solenoid 93 is set at 50% to position the spool 92 at the neutral position as shown in FIG. 9. Thus, the inlet port 91*a*, the retard port 91*c* and the advance port 91*b* are closed to maintain the cam phase constant.

In this manner, opening-closing period of the suction valve 11 can be advanced or retarded continuously over a range of 30 degrees of rotational angle of the suction cam shaft 6, by altering phase of the suction cam shaft 6 with regard to phase of the crankshaft 4 by means of the valve phase variable mechanism 50.

Next, modes of controlling the valve characteristic changing mechanism 13 and modes of changing the fuel injection amount and the ignition period with respect to the suction valve 11 will be described with reference to flow charts. Those with respect to the exhaust valve 12 are the same.

Figure 10:
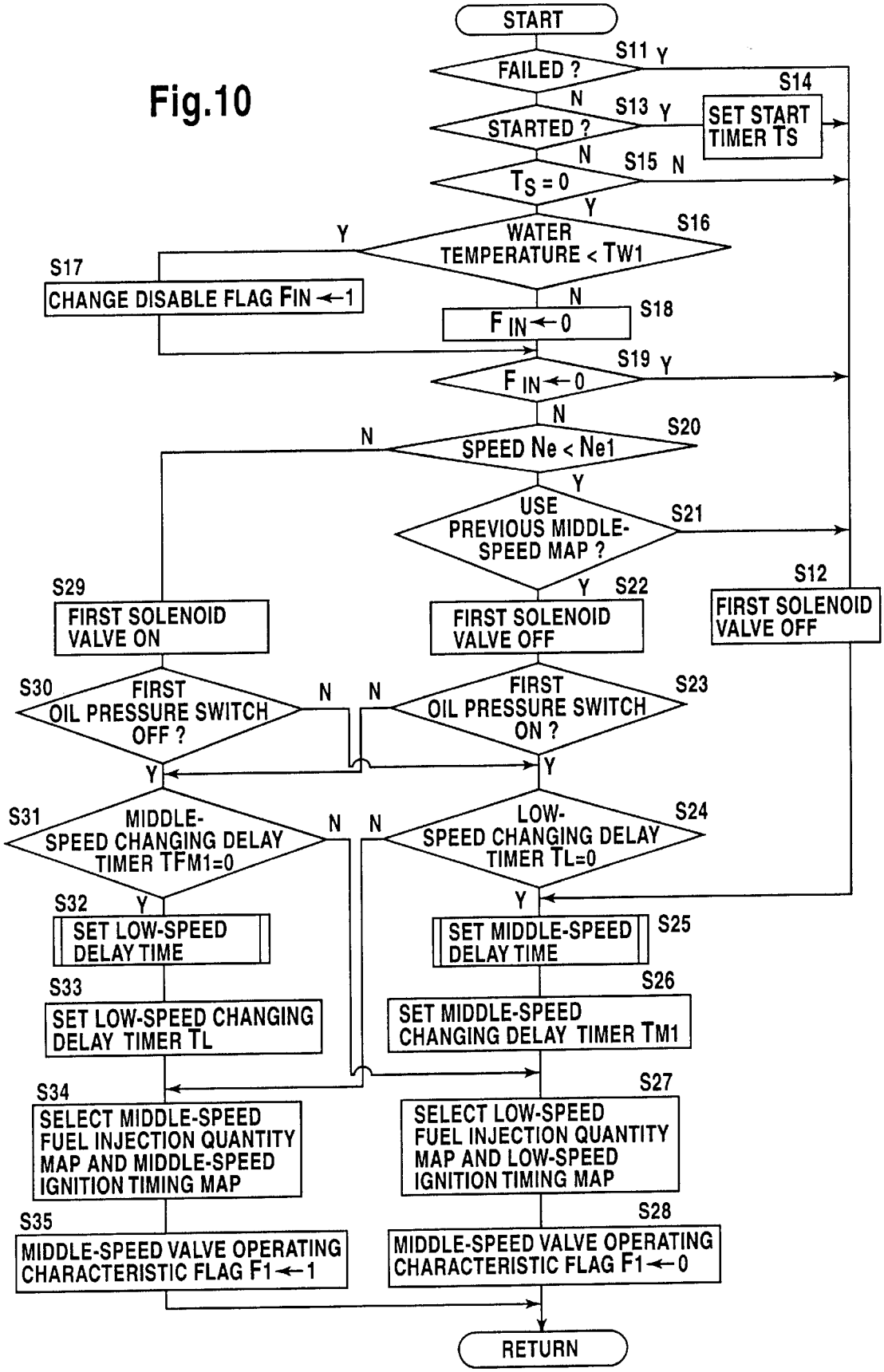
FIG. 10 is a flow chart showing a routine for changing valve operation characteristic and map by the valve characteristic changing mechanism at a low rotational speed and a middle rotational speed.

FIG. 10 is a flow chart showing a routine for changing valve operation characteristic between a low speed rotation and a middle speed rotation by the first connection changing mechanism 30 of the valve characteristic changing mechanism 13 and for changing maps of fuel ignition amount and ignition period. The routine is carried out every set times.

At the step S11, whether a sensor or the like is out of order or not is discriminated, and if it is out of order, close instruction is sent to the first solenoid valve 85 at the step S12 to obtain the low speed valve operation characteristic in which one of the suction valves 11 is driven by the cam for low speed 15 and another suction valve 11 is substantially closed to rest.

If it is discriminated to be not out of order at S11, the flow advances to S13, and if the engine 1 is in starting operation, and after-starting delay timer T5 is set at a set time, 5 seconds for example, at S14, then the flow advances to S12 to close the first solenoid valve 85.

When starting of the engine 1 is completed, until the after-starting delay timer TS times up at S15, the flow goes to S12 to maintain the first solenoid valve 85 in the closed state. When the set time of the after-starting delay timer TS elapses, namely when 5 seconds elapses after starting, whether the cooling water temperature TW is lower than a set water temperature TW1, for example 60°, or not, namely whether warming of the engine has been completed or not, is discriminated based on a detecting signal of a cooling water temperature sensor at S16. If it is in warming-up, a change prohibiting flag FIN for prohibiting changeover of the valve operation characteristic by the first connection changing mechanism 30 is set at "1" at the step S17, then the flow advances to the step S19.

When the warming-up is completed, the change prohibiting flag FIN is set at "0" at the step S18. At the step S19, whether the change prohibiting flag FIN is set at "1" or not, namely whether the change is prohibited or not, is discriminated, and when the change is prohibited, the close instruction is sent to the first solenoid valve 85 at the step S12.

If the change prohibiting flag FIN is not "1" at the step S19, whether the engine rotational speed detected by a rotational speed sensor is lower than a set rotational speed Ne1, for example 2000 rpm, or not is discriminated at the step S20, and when the rotational speed is lower than the set rotational speed Ne1, that is on low speed rotation, the flow advances to the step S21. When the fuel injection amount map and the injection period map for middle speed are not selected at the last time, namely when the first connection changing mechanisms 30 of all cylinders are not changed to middle speed valve operation characteristics, at the step S21, the flow advances to the step S12.

When maps of fuel injection amount and ignition period for middle speed have been selected at S21, the closing instruction is sent to the first solenoid valve 85 at S22, then whether the first oil pressure switch 88 is turned on or not, namely whether oil pressure of the first oil pressure supply passage 39 is low or not, is discriminated at S23. When the first solenoid valve 85 is changed over from open to close, until the first oil pressure switch is turned on at S23, the flow advances to S31 and further a series of treatments of STEPS s32 to S35, setting of delay time for low speed, setting of changing delay timer for low speed TL, selection of fuel injection amount map for middle speed used in fuel injection amount control routine and ignition period map for middle speed used in ignition period control routine, and setting of the middle speed valve operation characteristic flag F1 to "1", are carried out, to use the map for middle speed continuously.

When the first oil pressure switch 88 is turned on at S23, whether the set time of the changing delay timer for low speed TL has elapsed or not is discriminated at S24. When the set time of the timer TL does not elapse, fuel injection amount map for middle speed and the ignition period map for middle speed are selected at S34 and the middle speed valve operation characteristic flag F1 is set to "1" at S35.

When the set time of the changing delay timer for low speed TL elapses at S24, at all cylinders, the valve operation characteristic is changed from the middle speed valve operation characteristic in which both suction valves 11 are driven by the cam for low speed 15 to the low speed valve operation characteristic in which one of the suction valves 11 is driven by the cam for low speed 15 and another suction valve 11 is substantially closed to rest. Then, a delay time for middle speed is set at S25 and the time is set in the changing delay timer for middle speed TM1 at S26. In succession, the fuel injection amount map for low speed and the ignition period map for low speed are selected by the map changing means of the electronic control unit 76 at S27 to change from the map for middle speed to the map for low speed. Thereafter, the middle speed valve operation characteristic flag F1 is set to "0" at S28, because the valve operation characteristic at that time is the low speed valve operation characteristic.

If the engine rotational speed Ne is above the set rotational speed Ne1 at S20, opening instruction, that is, an instruction for changing to the middle speed valve operation characteristic is sent to the first solenoid valve 85 at S29. And whether the first oil pressure switch 88 turns off or not, that is, whether oil pressure of the first oil pressure supply passage 39 is high or not is discriminated at S30. When the first solenoid valve 85 is changed from "close" to "open", until the first oil pressure switch 88 is turned off from "on", the flow advances to S24, and further a series of treatments of steps S25 to S28, setting of delay time for middle speed, setting of changing delay timer TM1 for middle speed, selection of fuel injection amount map for low speed and ignition period map for low speed, and setting of the middle speed valve operation characteristic flag F1 to "0" are carried out, to use the map for low speed continuously.

When the first oil pressure switch 88 is turned off for showing high pressure of the first oil pressure supply passage 39 at S30, whether the changing delay timer for middle speed TM1 times up or not is discriminated at S31. If the set time of the timer TM1 does not elapse, the fuel injection amount map for low speed and the ignition period map for low speed are selected at S27 and the middle speed valve operation characteristic flag F1 is set to "0" at S28.

When the set time of the changing delay timer for middle speed TM1 elapses at S31, at all cylinders, the valve operation characteristic is changed from the low speed valve operation characteristic in which one of the suction valves 11 is driven by the cam for low speed 15 and another suction valve 11 is substantially closed to rest to the middle speed valve operation characteristic in which both suction valves are driven by the cam for low speed 15. Then, a delay time for low speed is set at S32 and the time is set in the changing delay timer for low speed TL at S33. In succession, the fuel injection amount map for middle speed and the ignition period map for middle speed are selected by the map changing means of the electronic control unit 76 at S34 to change from the map for low speed to the map for middle speed. Therefore, the middle speed valve operation characteristic flag F1 is set to "1" at S35.

The times which are set in the changing delay timers for low speed and middle speed TL, TM1 are set by a delay time setting routine to be mentioned later adapted to a time required for completing changing actions of the first connection changing mechanisms 30 of all cylinders when oil pressure of the first oil pressure supply passage 39 is altered, and reflect property of the oil operating the valve characteristic changing mechanism 13, particularly its viscosity. Therefore, responsiveness of changing of the valve operation characteristic to the oil property is taken into consideration. Accordingly, even if the oil property is altered by change of engine operational condition for example, timing of changing maps for low speed and maps for middle speed to each other after the delay time elapses coincides with timing of completion of changing of the valve operation characteristics at all cylinders, so that fuel injection amount and ignition period appropriate for the valve operation characteristic over a wide range of engine operation can be obtained and improvement of exhaust emission is possible.

When it is discriminated to be out of order at S11, when it is discriminated to be in starting at S13, when it is discriminated that 5 seconds do not elapse after completion of starting at S15, when the change prohibiting flag is not set to "1" at S19, and when fuel injection amount map and ignition period map for middle speed have been selected at S21, the flow advances to S12 to close the first solenoid valve 85. After that, a delay time for middle speed is set at S25, the time is set in the changing delay timer for middle speed TM1 AT S26, the fuel injection amount map for low speed and the ignition period map for low speed are selected at S27, and the middle speed valve characteristic flag F1 is set to "0" at S28.

Figure 11:
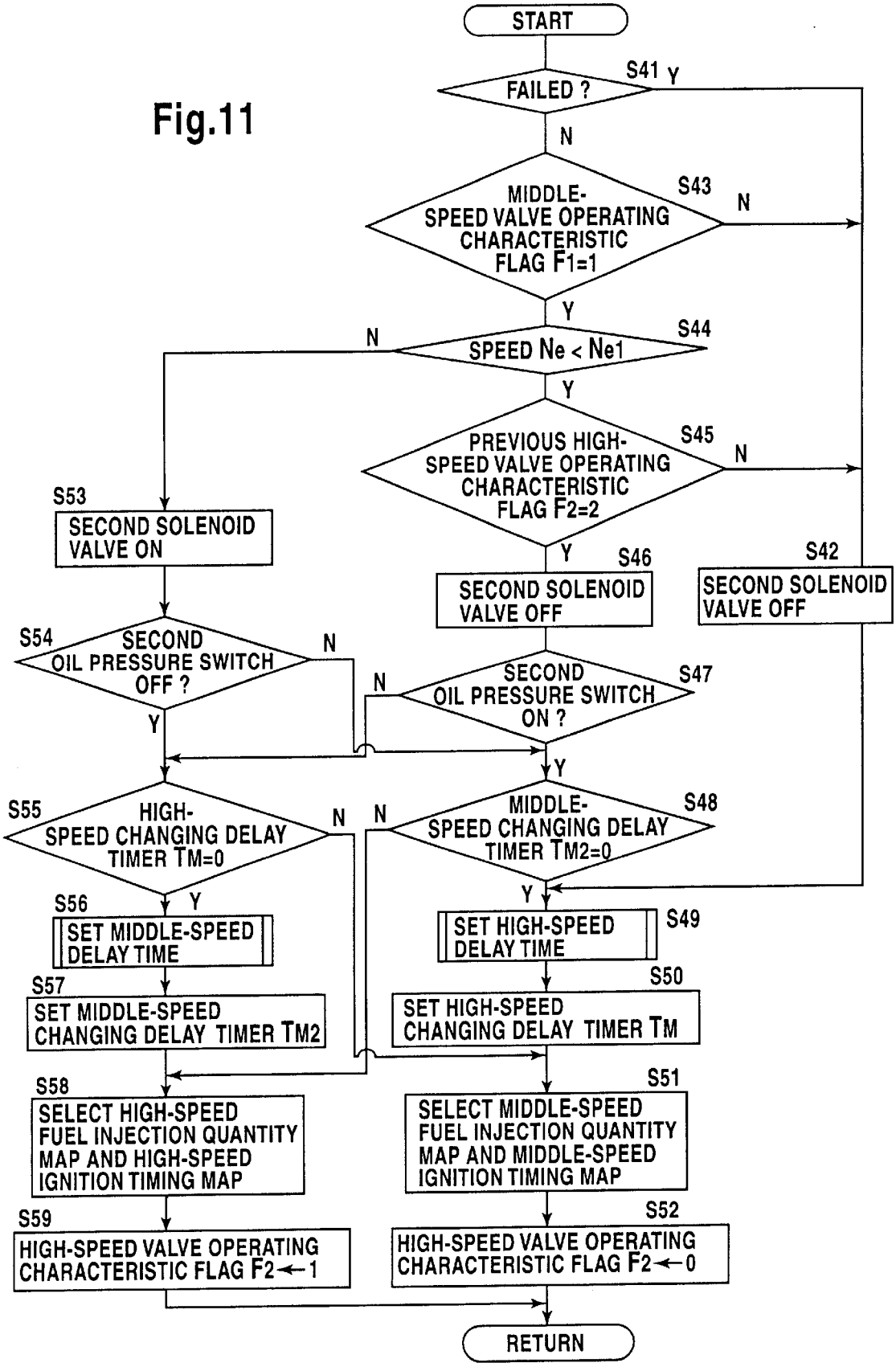
FIG. 11 is a flow chart showing a routine for changing valve operation characteristic and map by the valve characteristic changing mechanism at a middle rotational speed and a high rotational speed.

Next, a routine for changing valve operation characteristic and changing maps of fuel injection amount and ignition period between middle speed rotation and high speed rotation by the second connection changing mechanism 31 of the valve characteristic connection changing mechanism 31 of the valve characteristic changing mechanism 13. FIG. 11 shows this changing routine which is carried out every set times.

At S41, whether a sensor or the like is out of order or not is discriminated, and if it is out of order, chose instruction is sent to the second solenoid value at S42. In accordance with the engine rotational speed Ne at that time, the suction valves 11 becomes that low speed valve operation characteristic in which one of the suction valve 11 is driven by the cam for low speed 15 and another suction valve 11 is substantially closed to rest, or the middle speed valve operation characteristic in which both suction valves 11 are driven by two cam for low speed 15. After the second solenoid valve is closed at S42, the flow advances at S49.

If it is discriminated to be not out of order at S41, the flaw advances to S43 and whether the middle speed valve operation characteristic flag F1 is "1" or not, namely whether the suction valve 11 is in the middle speed valve operation characteristic or not is discriminated. If the valves 11 is not in the middle speed valve operation characteristic, close instruction is sent to the second solenoid valve at S42 and the valves 11 becomes the low speed valve operation characteristic in which one of the suction valves 11 is driven by the cam for low speed 15 and another suction valve 11 is substantially chose to rest.

When it is in the middle speed valve operation characteristic at S43, whether the engine rotational speed Ne is lower than a set rotational speed Ne2, for example 500 rpm, a not is discriminated at S 44, and when the engine rotational speed is lower than the set rotational speed Ne2, namely in middle speed operation, whether the high speed valve characteristic flag F2 has been set to "1" a not is discriminated at S45. If the high speed valve operation characteristic flag F2 is "0", namely if the second connection changing mechanism 31 of all cylinders are not changed to the high speed valve operation characteristic, the flow advances at A42. At that time the suction valve 11 are in the middle speed valve operation characteristic in which the suction valve 11 are driven by the cam for low speed 15.

When the high speed valve operation characteristic has been "1" at S45, after the close instruction is sent to the second solenoid valve at S46, whether or not the second oil pressure which is turned on, namely pressure of the second oil pressure supply passage 47 is low, is discriminated at S47.

When the second solenoid valve changes from "open" to "close", until the second oil pressure switch turns on at S47, the flow advances to S55, further a series of treatments of S56 to S59, namely setting delay time for middle speed, setting of the middle speed changing delay timer TM2, selection of the high speed fuel ignition amount map and the high speed ignition period map, and setting high speed valves apparatus characteristic of flag F2 to "1", are carried out to use the map for high speed continuously.

When the second oil pressure switch is turned on to lower the pressure at step S47, it is judged, at step S48, whether or not the set time elapses with the changing delay timer for middle speed TM2. When time is not up with the changing delay timer for middle speed TM2, the fuel injection quantity map for high speed and the ignition timing map for high speed are selected at step S88, and the high-speed valve operating characteristic flag F2 is set to "1" at step S89.

When the set time elapses with the changing delay timer for middle speed TM2 at step S48, all the cylinders are changed from high-speed valve operating characteristics in which both the suction valves 11 are driven by the cam for high speed 16 to middle-speed valve operating characteristics in which both the suction valves 11 are driven by the cam for low speed 15. The delay time for high speed is set at step S49 and the time is set to the changing delay timer for high speed TH at step S50. Successively, at step S51, the fuel injection quantity map for middle speed and the ignition timing map for middle speed are selected by the map changing means of the electronic control unit 76, thereby changing from the map for high speed to the map for middle speed. Thereafter, at step S52, the valve operating characteristics at this time are middle-speed valve operating characteristics, and hence the high-speed valve operating characteristic flag F2 is set to "0".

When the engine speed is equal to or more than the set speed Ne2 at step S44, a valve opening command of the second solenoid valve, i.e., a changing command to the high-speed valve operating characteristics, is issued at step S53. And, it is judged, at step S54, whether or not the second oil pressure switch is turned off, i.e. whether or not oil pressure of the second oil pressure supply passage 47 is increased to high pressure. At the time of changing from closing of the second solenoid valve to opening thereof, while the second oil pressure switch is turned from on to off at step S54, the flow proceeds to step S48, and furthermore a series of processes at steps S49 to S52 are executed, i.e. setting of the delay time for high speed, setting of the changing delay timer TH for high speed, a selection of the fuel injection quantity for middle speed and the ignition timing map for middle speed, and setting of the high-speed valve operating characteristic flag F2 to "0" are executed, and the map for middle speed is continuously used.

When the second oil pressure switch is turned off to increase the pressure of the second oil pressure supply passage 47 at step S54, it is judged, at step S55, whether or not the set time elapses with the changing delay timer for high speed TH. When the set time has not elapsed with the changing delay timer for high speed TH, the fuel injection quantity map for middle speed and the ignition timing map for middle speed are selected at step S51, and the high-speed valve operating characteristic flag F2 is set to "0" at step S52.

When the set time elapses with the changing delay timer for high speed TH is at step S55, all the cylinders are changed from middle-speed valve operating characteristics in which both the suction valves 11 are driven by the cam for low speed 15 to high-speed valve operating characteristics in which both the suction valves 11 are driven by the cam for high speed 16. And, the delay time for middle speed is set at step S56 and the time is set to the changing delay timer for middle speed TM2 at step S57. Successively, at step S58, the fuel injection quantity map for high speed and the ignition timing map for high speed are selected by the map changing means of the electronic control unit 76, thereby changing from the map for middle speed to the map for high speed. Thereafter, at step S59, the high-speed valve operating characteristic flag F2 is set to "1".

In this step also, the delay time to be set to the delay timers for middle speed TM2 and high speed TH is set in conformity with a period of time in which oil pressure of the second oil pressure supply passage 47 changes and the second connection changing mechanisms 31 of all the cylinders have completed changing operations, and the values are set in the below-described delay time set routine as well as the delay time in the first connection changing mechanism 30. Accordingly, properties of oil affect the time, and even if the oil properties change due to change in driving state of the engine, timing of changing between both the maps for middle speed and both the maps for high speed after this delay time has elapsed substantially coincides with a timing in which changing of the valve operating characteristics of all the cylinders has completed. For this reason, the fuel injection quantity and the ignition timing are set appropriately for the valve operating characteristics in a wide range of an engine drive region, thereby enabling improvement in exhaust emission.

In this connection, when it is judged, at step S41, that a fault occurs, when the middle-speed valve operating characteristics flag F1 is not set to "1" at step S43, and when the previous high-speed valve operating characteristic flag F2 is not set to "1" at step S45, the flow proceeds to step S42 as described above, and the second solenoid valve is closed, thereafter the delay time for high speed is set at step S49, and the time is set to the changing delay timer for high speed TH at step S50, the fuel injection quantity map for middle speed and the ignition timing map for middle speed are selected at step S51, and the high-speed valve operating characteristic flag F2 is set to "0" at step S52.

A control aspect of a valve phase variable mechanism 50 will be described with reference to a flowchart.

Figure 12:
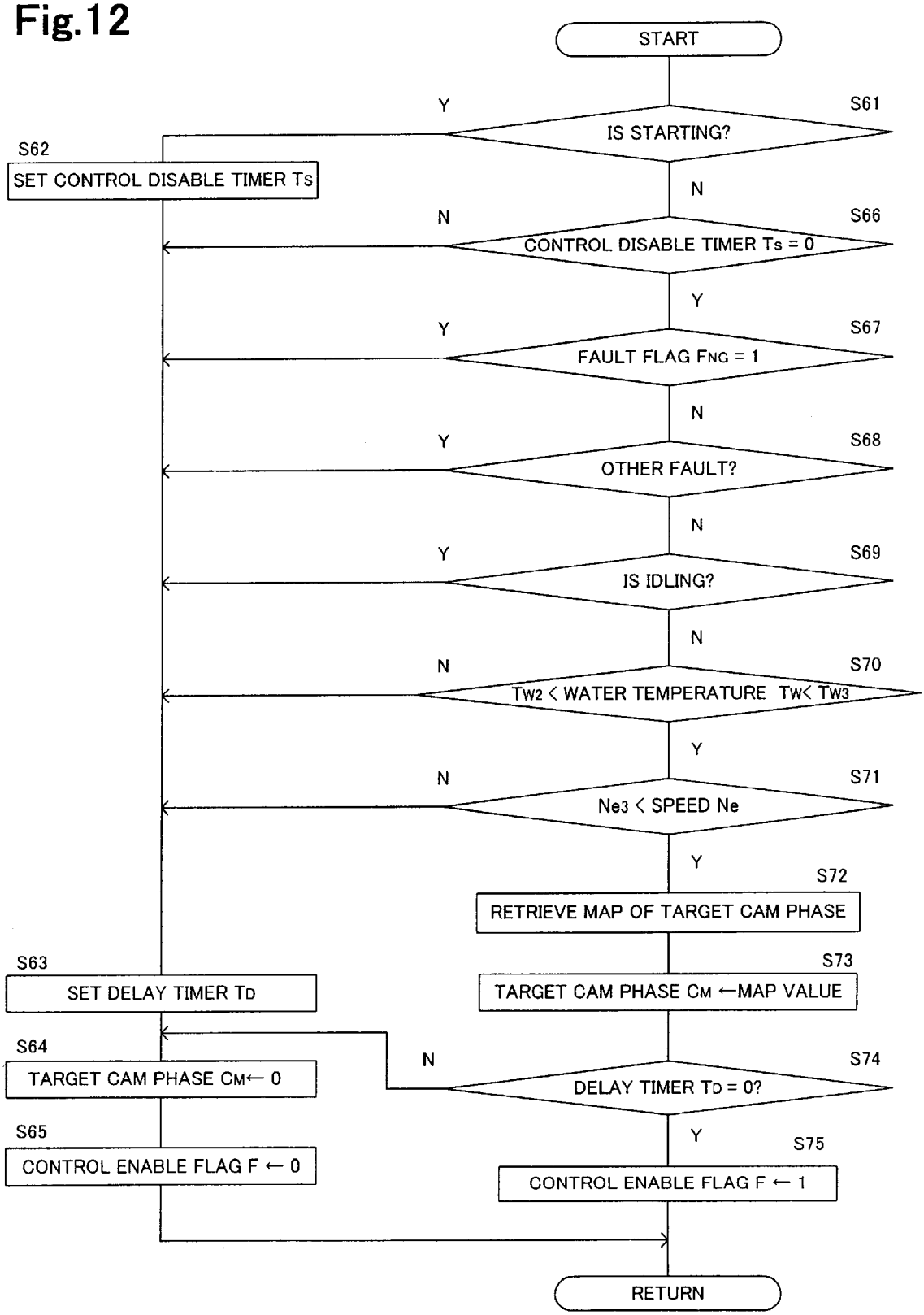
FIG. 12 is a flow chart showing a routine for calculating target cam phases.

A flowchart of FIG. 12 shows a routine of calculating a target cam phase and this routine is executed in each set time.

First of all, when the internal combustion engine 1 is driven for starting at step S61, a started state cam phase control disable timer TS is set to a set time, e.g., 5 sec, at step S62, a valve phase variable mechanism operating delay timer TD is set to a set time, e.g., 0.5 sec, at step S63, and a target cam phase CM is set to "0", at step S64, and a valve phase variable mechanism control enable flag F indicating whether to enable operation of the valve phase variable mechanism 50 is set to "0", at step S65, and the operation is disabled.

When the internal combustion engine 1 has completed starting, until the set time elapses with the started state cam phase control disable timer TS at step S66, the flow proceeds to step S63, and, in turn, transfer to steps S64 and S65, and the operation of the valve phase variable mechanism 50 is disabled. When the set time elapses with the started state cam phase control disable timer TS and 5 sec elapses after started, the flow transfers to step S67. If a valve phase variable mechanism fault flag FNG is set to "1" at step S67, or a fault of a sensor, etc. other than the valve phase variable mechanism 50 of a sensor, etc. occurs at step S68, the flow transfer to steps S63 to S65, and the operation of the valve phase variable mechanism 50 is disabled.

If a fault does not occur in both steps S67 and S68, it is judged, at step S69, whether or not the internal combustion engine 1 is driven idly, at step S69. During the idle driving, e.g., a throttle valve opening detected by a throttle valve opening sensor is an entirely closed state, and also when engine speed detected by a speed sensor is in the proximity of 700 rpm, the flow transfers to steps S63 to S65, and the operation of the valve phase variable mechanism 50 is disabled.

If not during the idle driving at step S70, it is judged whether or not coolant temperature TW detected by a coolant temperature sensor is between a lowermost value TW2, e.g., 0° C. and an uppermost value TW3, e.g., 110° C. It is judged, in turn, at step S71, whether or not engine speed Ne detected by the speed sensor is higher than a lowermost value Ne3, e.g., 1500 rpm, and if respective conditions of steps S70 and S71 prove abortive, the flow transfers to steps S63 to S65, and the operation of the valve phase variable mechanism 50 is disabled.

When it is judged, at step S71, that the engine speed Ne is higher than the lowermost value Ne3, the flow transfers to step S72 so that the valve phase variable mechanism 50 is operated. At step S72, a map of a target cam phase set by use of negative a suction minus pressure and the engine speed as parameters is retrieved. Here, a means for retrieving a target cam phase CM at step S72 is a target phase setting means.

At step S73, the value procured by retrieving at step S72 is set as the target cam phase CM. At step S74, in order to prevent hunting when the valve phase variable mechanism 50 is transferred from a non-operating state to an operating state, after the valve phase variable mechanism operating delay timer TD awaits time-up, the valve phase variable mechanism control enable flag F is set to "1" at step S75, and the operation of the valve phase variable mechanism 50 is enabled.

Figure 13:
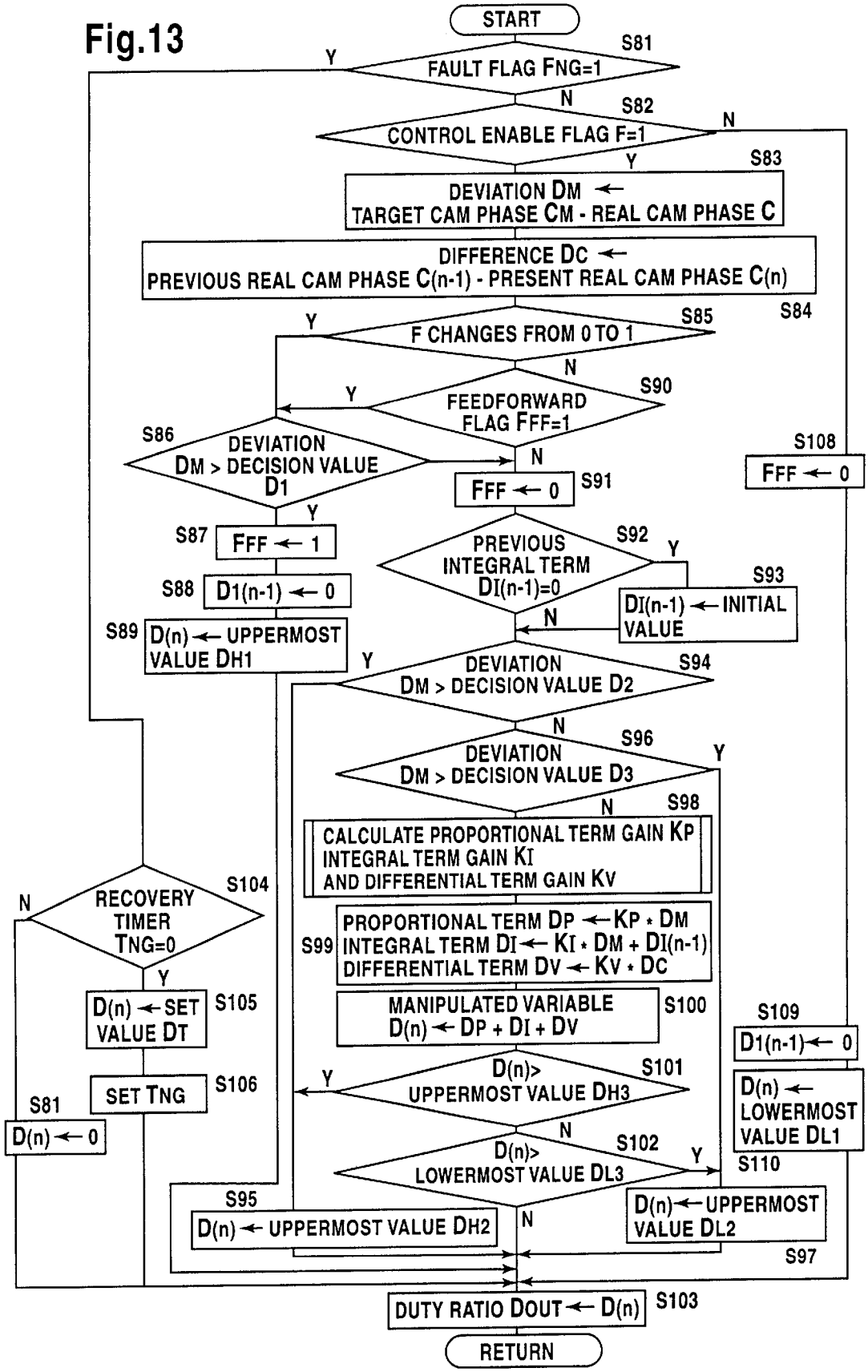
FIG. 13 is a flow chart showing a feedback control routine of the valve phase variable mechanism.

A flowchart of FIG. 13 shows a routine of feedback-controlling a cam phase by means of the valve phase variable mechanism 50, and this routine is executed in each set time.

First of all, when a valve phase variable mechanism fault flag FNG is not set to "1" at step S81 and the valve phase variable mechanism 50 is normal, and further the valve phase variable mechanism enable flag F is set to "1" at step S82 and the valve phase variable mechanism 50 is being operated, a deviation DM between the target cam phase CM calculated in a target cam phase calculation routine and a real cam phase C which is an actual cam phase calculated from outputs of a suction cam shaft sensor 67 and a crankshaft sensor is calculated at step S83, and also a difference DC between a real cam phase C(n−1) in a previous loop and a real cam phase C(n) in a present loop is calculated at step S84. Here, a means for calculating the real cam phase C from the outputs of the suction cam shaft sensor 67 and the crankshaft sensor is a phase detecting means.

If the valve phase variable mechanism control enable flag F changes from "0" to "1" at next step S85, i.e., in case the operation of the valve phase variable mechanism 50 is changed from the disable to the enable in a present loop, the flow transfers to step S86, and the deviation DM is compared with a first feedforward control decision value D1, e.g., a value corresponding to 10° crank angle. This results in that, if the deviation DM is greater than the first feedforward control decision value D1, a feedforward control flag FFF is set to "1" at step S87, and the valve phase variable mechanism 50 which should intrinsically be feedback-controlled is feedforward-controlled.

That is, after a manipulated variable D(n) in a present loop of the valve phase variable mechanism 50 is set to an uppermost value DH1 at step S89, a duty ratio DOUT of a linear solenoid valve 90 of the valve phase variable mechanism 50 is set as a present manipulated variable D(n) at step S103. In subsequent loops, as the decision result at step S85 is NO and also the decision result at step S90 is YES, the deviation and the first feedforward control decision value D1 are recompared in size at step S86, and while the deviation DM is greater, the flow transfers to step S103 through steps S87 to S89.

Accordingly, if a deviation DM between a target cam phase CM and a real cam phase C is great, when the valve phase variable mechanism 50 is started controlling, a present manipulated variable D(n) of the valve phase variable controlling is set to the uppermost value DH1 which is a constant, while the state continues, whereby the valve phase variable mechanism 50 is feedforward-controlled. As mentioned above, only while convergence is feared since the deviation DM is great, the feedforward control continues, with the result that responsibility and convergence can be made compatible.

In case the deviation DM is equal to or smaller than the first feedforward control decision value D1 from the beginning of control at step S86, or in case the deviation DM becomes equal to or smaller than the first feedforward control decision value D1 during the aforesaid feedforward control, the feedforward control flag FFF of the valve phase variable mechanism 50 is set to "0" at step S91, and the flow transfers to step S92. At step S92, if a previous integral term D1(n−1) is zero, a previous integral term D1(n−1) is set to an initial value at step S93.

At step S94, the deviation DM (in case the target cam phase CM is greater than the real cam phase C) is compared with a second feedforward control decision value D2 which is smaller than the first feedforward control decision value D1. This results in that, if the deviation DM between the both is great, after a present manipulated variable D(n) is set to an uppermost value DH2 at step S95, the duty ratio DOUT of the linear solenoid valve 90 is set as the present manipulated variable D(n) at step S103.

Likewise, at step S96, the deviation DM (in case the target cam phase CM is smaller than the real cam phase C) is compared with a third feedforward control decision value D3 which is smaller in absolute value than the first feedforward control decision value D1. This results in that, if the deviation DM between the both is great, the duty ratio DOUT of the linear solenoid valve 90 is set as the present manipulated variable D(n) at step S103 after a present manipulated variable D(n) is set to a lowermost value DL2 at step S97,.

Thus, even after the deviation DM becomes the first feedforward control decision value D1 or less at step S86, until the deviation DM becomes the second and third feedforward control decision value D2, D3 or less at steps S94, S96, the present manipulated variable D(n) is switched from the uppermost value DH1 to the uppermost value DH2 or the lowermost value DL2 and the feedforward controlling continues, whereby the responsibility and convergence are contrived to make compatible.

If the absolute value of the deviation DM is sufficiently reduced by the aforesaid feedforward control and both the steps S94 and S96 end in failure, after a proportional term gain KP, an integral term gain K1, and a differential term gain KV are calculated at step S98 in order to perform PID feedback controlling, a proportional term DP, an integral term DI, and a differential term DV are calculated by the following equation at step S99, respectively:

$$DP=KP*DM$$

$$DI=KI*DM+DI(n-1)$$

$$DV=KV*DC$$

At step S100, the present manipulated variable D(n) of the PID feedback controlling is calculated as a sum of the proportional term DP, the integral term DI, and the differential term DV.

Successively, at steps S101 and S102, a limit process of the present manipulated variable D(n) is executed. That is, if the present manipulated variable D(n) exceeds an uppermost value DH3 at step S101, an uppermost value DH2 is set as the present manipulated variable D(n) at step S95, and also if the present manipulated variable D(n) is less than a lowermost value DL3 at step S102, a lowermost value DL2 is set as the present manipulated variable D(n) at step S97. At step S103, the present manipulated variable D(n) is used as the duty ratio DOUT of the linear solenoid valve 90, and the valve phase variable mechanism is feedback-controlled so that the deviation DM between the target cam phase CM and the real cam phase C is converged to zero.

In the meantime, when the valve phase variable mechanism 50 is failing at step S81 and a valve phase variable mechanism fault flag FNG is set to "1", at step S105 through step S104, a value of the present manipulated variable D(n) is set to, e.g., a fault recovery set value DT equivalent to the duty ratio 50% of the linear solenoid valve 90, and at next step S106, a fault recovery timer TNG is set. While the set time elapses with the fault recovery timer TNG from a next loop, a decision result at step S104 is NO and the present manipulated variable C(n) is set to "0" at step S107.

According to such control, in case the valve phase variable mechanism 50 failed. the valve phase variable mechanism 50 is set in a most angularly retarded state, and besides the linear solenoid valve 90 forthwith interconnects an inflow port 91*a* to an angular advance port 91*b* within a set time, and the valve phase variable mechanism 50 can be operated to an angularly advanced side. This results in that, in case a fault occurs due to bite-in of dust, or in case a fault decision is made in an instant by pulsation, etc. of the oil pressure circuit, the valve phase variable mechanism 50 or the linear solenoid valve 90 can automatically be recovered to a normal state.

Furthermore, when the valve phase variable mechanism control enable flag F is set to "0" at step S82 and the operation of the valve phase variable mechanism 50 is disabled, the valve phase variable mechanism feedforward control flag FFF is set to "0" at step S108, and, in turn, after the present manipulated variable D(n) of the valve phase variable mechanism 50 is set to the lowermost value DL1 at step S109, the duty ratio DOUT of the linear solenoid valve 90 of the valve phase variable mechanism 50 is set as the present manipulated variable D(n) at step S103.

Figure 14:
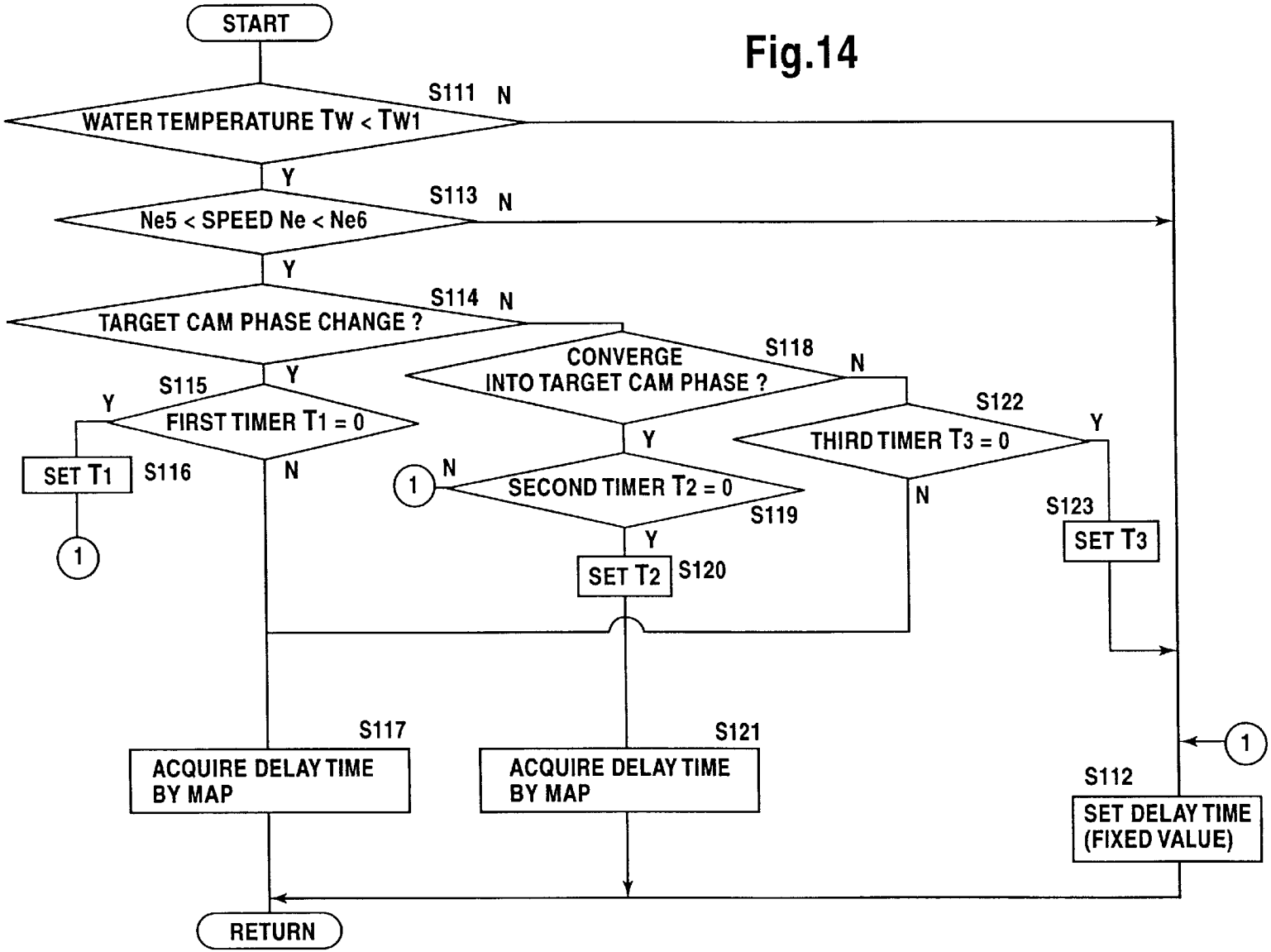
FIG. 14 is a flow chart showing a routine for setting delay times.

A flowchart of FIG. 14 is a flowchart of valve operating characteristics by the first connection changing mechanism 30 and a changing routine of both the maps of fuel injection quantity and ignition timing as shown in FIG. 10, indicating a delay time set routine executed at respective steps S25 and S32 for setting a delay time to be set to respective changing delay timers for low speed and middle speed TL, TM1.

By use of the difference DC between the previous real cam phase C(n−1) and the present real cam phase C(n) calculated in feedback control of the cam phase by the valve phase variable mechanism 50, i.e., a change speed of the real cam phase C, and the duty ratio of a current quantity which is duty-controlled for retaining a spool 92 of the linear solenoid valve 90 at a neutral position, properties of oil which is an operating oil are detected and a delay time is set based on the detected oil properties.

First, it is judged, at step Slll, whether or not coolant temperature TW is lower than a set value TW4 (e.g., 80° C.) higher than a warm-up decision temperature based on a detection signal from a coolant temperature sensor. When the coolant temperature TW is lower than the set value TW4, as oil temperature takes various values according to a state of the internal combustion engine 1, the oil properties represented by the viscosity of an oil are various. Therefore, it is necessary to know the oil properties including the viscosity of an oil, in order that the operating responsibility of a valve characteristic changing mechanism 13 depending on the oil properties, i.e., a time required for changing operation is accurately evaluated. On the other hand, when the coolant temperature TW is equal to or more than this set value TW4, great changes do not occur in the operating responsibility of the valve characteristic changing mechanism 13 due to changes in oil temperature. Therefore, in case it is judged that the coolant temperature TW is equal to or more than the set value TW4 at step S111, control proceeds to step S112, and the delay time is constant to a set value (a fixed value), e.g., 0.2 sec.

When the coolant temperature TW is lower than the set value TW4, it is judged, at step S113, whether or not the engine speed Ne is in the range of the set lowermost value Ne5 and the uppermost value Ne6 containing the changing speed of valve operating characteristics by the valve characteristic changing mechanism 13, e.g., in the range of 1000 to 3000 rpm, based on a detection signal from the speed sensor. When the engine speed is outside this range, the delay time is set as a set value at step S112.

When it is judged that the engine speed Ne is within the set range at step S113, it is judged, at step S114, whether or not the present target cam phase CM(n) changes from the previous target cam phase CM(n−1), and in case there is a change, it is judged, at step S115, whether or not the set time elapses with a first timer T1 with the passage of a set time, e.g., a predetermined time of a period of time of 1 to 2 sec, and when the set time elapses, after the set time is set in the first timer T1 at step S116, the flow proceeds to step S112.

Figure 16:
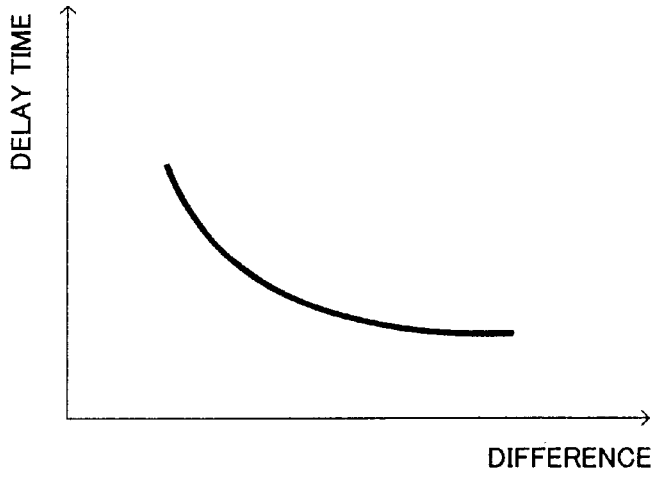
FIG. 16 is a map showing a relation between the delay time and variation of the actual cam phase.

In case it is judged, at step S115, that the set time has not elapsed with the first timer T1, at step S117, a delay time is acquired with reference to a map indicating a relationship between the delay time and the difference DC as shown in FIG. 16, based on the difference DC between the previous real cam phase C(n−1) and the present real cam phase C(n) which is acquired at step S84 in the flowchart of the feedback control routine of FIG. 13. Here, a means for acquiring the difference DC between the previous real cam phase C(n−1) and the present real cam phase C(n) at step S84 is a phase change speed calculating means for calculating a change speed of a phase, constituting an operating oil property detecting means. Furthermore, a means for acquiring a delay time at step S117 is a delay time setting means. In this connection, two types of map are prepared for use in the aforesaid steps S25 and S32, respectively, and are stored in a memory of an electronic control unit 76.

The reason why it is possible to detect the oil properties from the difference DC between the previous real cam phase C(n−1) and the present real cam phase C(n) is that the valve phase variable mechanism 50 as a device for changing a cam phase is operated by the pressure of the oil and that the behavior depends on the oil properties such as viscosity of the oil, etc.

That is, in the valve phase variable mechanism 50, oil controlled by the linear solenoid valve 90 is supplied to an angular advance chamber 61 and an angular retard chamber 62 of the valve phase variable mechanism 50 to rotate a suction cam shaft 6. Accordingly, after the linear solenoid valve 90 starts controlling an opening area of an advance port 91*b* and a retard port 91*c*, and further after the oil passes through the oil passage and flows into the advance chamber 61 or the retard chamber 62, the suction cam shaft 6 starts rotating by a difference in oil pressures between the advance chamber 61 and the retard chamber 62, and a state of the valve phase variable mechanism 50 changes until the rotation ends. It is evident that such the state change depends on the oil properties represented by the viscosity of oil (oil temperature is one index indicating the oil properties, but this also finally relates to the viscosity of an oil). Therefore, it is possible to detect the properties of oil based on behavior of the valve phase variable mechanism 50. Here, rotation state of the suction cam shaft 6 reflects the behavior of the valve phase variable mechanism 50 after the oil flows into the advance chamber 61 or the retard chamber 62, and the oil properties are detected from such rotation state.

This set time is determined taking into consideration a follow-up property of the real cam phase C with respect to the target cam phase CM (it is obvious that this follow-up property reflects the oil properties from the above), and the behavior of the valve phase variable mechanism 50 for a while immediately after the target cam phase CM changes reflects more accurately the oil properties because the advance port 91*b* or the retard port 91*c* of the linear solenoid valve 90 is entirely opened. After this set time has elapsed, judging from the operating responsibility of the valve phase variable mechanism 50, there are great possibilities that the actual cam phase is in the vicinity of the target cam phase CM, and therefore the spool 92 of the linear solenoid valve 90 is in a state of approaching a neutral position for clogging the advance port 91*b* and the retard port 91*c*, and the change of the real cam phase C does not reflect accurately the oil properties. For this reason, the delay time is designed not to set from the change of the real cam phase C at this time.

When it is judged, at step S114, that the target cam phase does not change, it is judged, at step S118, whether or not the absolute value of the difference between the target cam phase CM and the real cam phase is within a value equivalent to 2° in crank angle, i.e., whether or not the real cam phase C converges to the target cam phase CM. When it is judged, at step S118, that there is a convergence, it is judged, at step S119, whether or not the set time elapses with a second timer T2 with the elapse of a set time, e.g., 0.5 sec, and when the set time has not elapsed, process proceed to step S112. This set time is a latency until the real cam phase C coincides with the target cam phase CM from the vicinity of the target cam phase CM and the spool 92 of the linear solenoid valve 90 reaches a neutral position.

Figure 17:
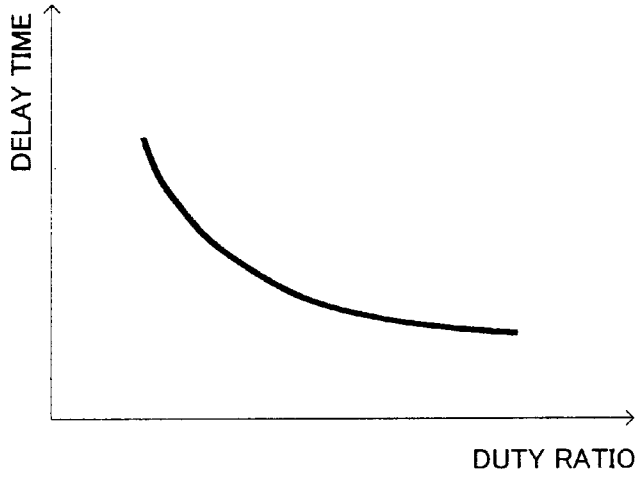
FIG. 17 is a map showing a relation between the delay time and duty ratio of the electric current to the linear solenoid valve which is in a neutral position.

When it is judged, at step S119, that the set time of the second timer T2 elapses, it is judged that a cam phase, i.e., a phase of a suction valve 11, is equal to the target cam phase CM to be fixed, and after a set time is set to the second timer T2 at step S120, a delay time is acquired at step S121, with reference to a map illustrating a relationship between a delay time and a duty ratio as shown in FIG. 17 based on the duty ratio of the linear solenoid valve 90 when the spool 92 is at a neutral position. Here, in a valve operating control means of the electronic control unit 76, a means for determining a duty ratio of a current quantity for retaining the spool 92 of the linear solenoid valve 90 at a neutral position is an operating oil property detecting means. Furthermore, a means for acquiring a delay time is a delay time setting means at step S121. Similarly to the map illustrating a relationship between a delay time and a difference D as shown in FIG. 16, two types of map are prepared for use in the aforesaid steps S25 and S32, respectively, and are stored in a memory of the electronic control unit 76.

The oil properties can be detected by the duty ratio of the linear solenoid valve 90 when the spool 92 is at a neutral position for retaining the cam phase at a constant value because a coil portion of the linear solenoid valve 90 is affected by an atmospheric temperature and its resistant value changes. That is, in a state that the linear solenoid valve 90 is warmed up, a current quantity when the spool 92 occupies the neutral position is set to be a duty ratio of 50%, but since a coil temperature of the linear solenoid valve 90 is also low during warming up and its resistant value is smaller than a value after warmed up, electric current with respect to the linear solenoid valve 90 is easy to flow. When current is easy to flow as mentioned above, in a state that a battery voltage is constant during warming up and after warmed up, a current quantity for retaining a neutral position of the spool 92 is same, but the duty ratio may be smaller than that after warmed up, and as the coil temperature is lower, the smaller is the duty ratio. On the other hand, as mentioned above, as oil temperature is also low during warming up, the viscosity as an oil property is larger than that after warmed up, and as the oil temperature is lower, this viscosity is larger. Accordingly, it is possible to detect the viscosity as an oil property by the duty ratio of the linear solenoid valve 90 when the spool 92 occupies the neutral position, i.e., when the cam phase is held constant.

When it is judged, at step S118, that the real cam phase C does not converge to the target cam phase CM, and when it is judged, at step S122, that the set time of a third timer T3 is up with the elapse of a set time, e.g., a predetermined time of a period of time of 1 to 2 sec, after the set time is set to the third timer T3 at step S123, the flow proceeds to step S112.

When it is judged, at step S122, that the set time has not elapsed with the third timer T3, the flow proceeds to step S117, and the delay time is acquired based on the difference DC. In this connection, the set time of the third timer T3 has the same sense as the set time set to the first timer T1.

Also in the flowchart of the valve operating characteristics by a second connection changing mechanism 31 and the changing routine of both the maps of fuel injection quantity and ignition timing as shown in FIG. 11, in order to set the delay time to be set to respective delay timers for middle speed and high speed TM2, TH, the below routine is also used as a delay time setting routine which is executed at respective steps S49 and S56. Namely, as a set range of the engine speed Ne at step S113 in the flowchart of a routine for setting the delay time of the aforesaid first connection changing mechanism 30, the lowermost value is changed to 4000 rpm and the uppermost value Ne6 is changed to 6000 rpm, respectively, with the other steps remaining the same.

In this connection, the same routine as the routine for setting the delay time of the valve characteristic changing mechanism 13 at a suction valves 11 side is used in case the delay time of the valve characteristic changing mechanism 13 at an exhaust valve 12 side is set.

As the embodiment is constituted as above, the following effects can be exhibited.

The delay time, which determines a changing timing between the fuel injection quantity map and the ignition timing map in response to each of valve operating characteristics for low speed, middle speed, and high speed which are changed by the valve characteristic changing mechanism 13, is reflected by the oil properties operating the valve characteristic changing mechanism 13, in particular its viscosity, and as a result, it is equal to a value taking account of responsibility of changing operation of valve operating characteristics dependent on the oil properties. Accordingly, even if the oil properties change due to a change of the driving state of the engine, a timing of changing between the fuel injection quantity map and the ignition timing map after this delay time has elapsed substantially coincides with a timing when change of the valve operating characteristics of all the cylinders has been completed. For this reason, the fuel injection quantity and the ignition timing are suited for the valve operating characteristics ranging over a wide-range engine drive region and an improvement in exhaust emission is made possible.

As factors which influences on the oil properties, here, in addition to a factor (e.g., oil temperature) based on the engine drive state, there are types of oil, a secular change of oil, and the like, but all the factors are fetched in, and as the delay time can be set based on the resultant oil properties, it is possible to set the delay time more precisely than, e.g., the case of making use of the oil properties detected by an oil temperature sensor, and accordingly it is possible to set a more precise changing timing of both the maps of fuel injection quantity and ignition timing.

The oil properties can be detected based on a behavior of the valve phase variable mechanism 50 operating by an oil pressure of an oil, i.e., based on the deviation DM between the target cam phase CM calculated from a change of the real cam phase C dependent on operation of the valve phase variable mechanism 50 and the real cam phase C, or the difference DC (a change speed) of the real cam phase C. Therefore, a detection means for directly detecting the oil properties, e.g., an oil temperature sensor, is unnecessary and costs can be reduced.

Furthermore, since the difference DC of the real cam phase C is utilized, even in case the phase changes greatly, or in case it changes continuously, detection of operating oils properties is possible. Therefore, it is possible to detect in sequence the operating oils properties in the wide-range engine drive region.

In the difference DC of the real cam phase C which is utilized when the delay time is set, and the deviation DM between the target cam phase CM and the real cam phase C, it is possible to make use of data obtained in a process of feedback-controlling the cam phase to the target cam phase CM. Therefore, detection of the operating oil properties from a change of the cam phase does not need a peculiar device for acquiring the difference DC of the real cam phase C and the deviation DM between the target cam phase CM and the real cam phase C.

On the basis of a behavior of the linear solenoid valve 90 controlling the pressure of oil supplied to the valve phase variable mechanism 50, i.e., on the basis of the duty ratio of a current quantity which is duty-controlled to the linear solenoid valve 90 when the spool 92 is at a neutral position for retaining fixedly the cam phase, the oil properties can be detected. Therefore, even in the engine drive region in which the cam phase does not change, it is possible to set the delay time in response to the oil properties.

Figure 18:
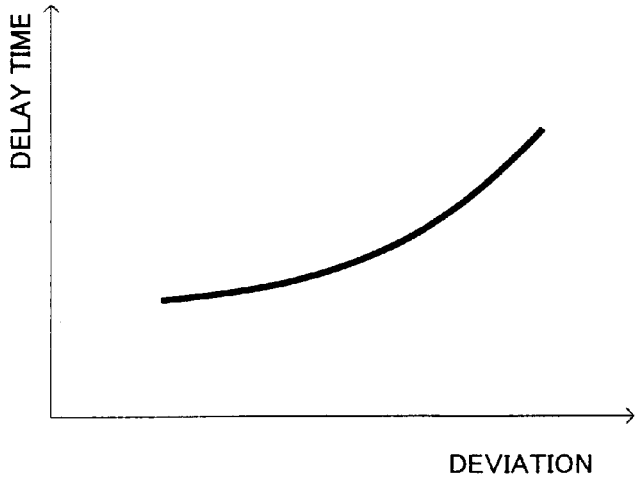
FIG. 18 is a map showing a relation between the delay time and deviation of the actual cam phase from the target cam phase.

A second embodiment of the present invention will now be described with reference to FIGS. 15 and 18, and according to the second embodiment of the present invention, only a delay time setting routine executed at respective steps S25, S32, S49, S56 differs for setting the delay time to be set in the respective changing delay timers for low speed, middle speed, and high speed TL, TM1, TM2, TH, and the other constitution is the same as in the first embodiment.

This routine sets the delay time for setting to the respective delay timers for low speed and middle speed TL, TM1, and by making use of the deviation between the target cam phase CM and the real cam phase C which are calculated in feedback-controlling of the cam phase by the valve phase variable mechanism 50, and the duty ratio of a current quantity which is duty-controlled for retaining the spool 92 of the linear solenoid valve 90 at a neutral position, the properties of oil which is an operating oil are detected and the delay times for low speed and middle speed are set based on the detected oil properties.

Figure 15:
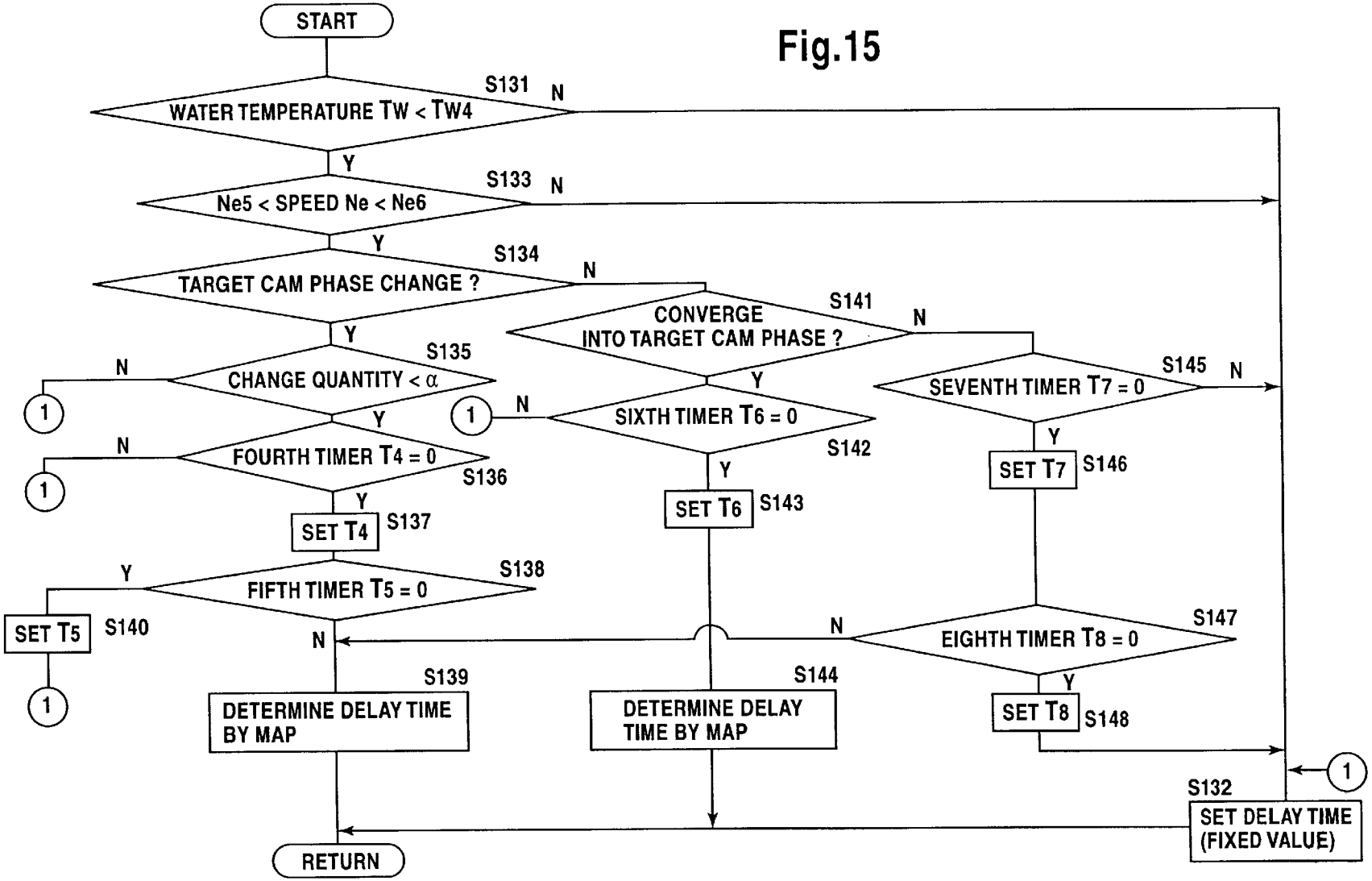
FIG. 15 is a flow chart showing another routine for setting delay times.

In a flowchart of FIG. 15, as steps S131 and S133 are the same as steps S111 and S112 of the flowchart of FIG. 14, the description will be omitted. However, in case a decision result at both the steps S131 and S133 is NO, the flow proceeds to step S132, and a delay time is set to a set value (a fixed value), e.g., 0.2 sec.

If it is judged, at step S133, that the engine speed Ne is within a set range, it is judged, at step S134, whether or not a present target cam phase CM(n) changes from the previous target cam phase CM(n−1), and in case there is a change, it is judged, at step S135, whether or not a change quantity of the target cam phase CM is smaller than a set value α. Interpreting this step S135, in case the oil properties are detected from the deviation DM between the target cam phase CM and the real cam phase C, as a course of changes of the target cam phase CM is various, the deviation DM under the conditions as same as possible must be utilized. This set value α is occasionally determined by experiments, etc. taking into account the above circumstances.

In case a change quantity of the target cam phase CM is equal to or more than a set value α at step S135, it is difficult to detect accurate oil properties from the above reasons, so that the flow proceeds to step S132, and the delay time is set to a set value (a fixed value), e.g., 0.2 sec.

In case a change quantity of the target cam phase CM is less than the set value α at step S135, it is judged, at step S136, whether or not the set time has elapsed with a fourth timer T4, and when the time has elapsed, timed out, after the set time is set to the fourth timer T4 at step S137, the flow proceeds to step S138. When the set time has not elapsed with a fifth timer T5 at step S138, at step S139, based on the deviation DM between the target cam phase CM and the real cam phase C acquired at step S83 in the flowchart of the feedback control routine of FIG. 13, a delay time is acquired with reference to a map illustrating a relationship between the delay time and the deviation DM as shown in FIG. 18. Here, a means for acquiring the deviation DM between the target cam phase CM and the real cam phase C at step S83 is an operating oil properties detection means. Furthermore, a means for acquiring a delay time at step S139 is a delay time setting means. Incidentally, two types of map are prepared for use in the aforesaid steps S25, S32, respectively, and are stored in a memory of the electronic control unit 76.

The reason why it is possible to detect the oil properties from the deviation DM between the target cam phase CM and the real cam phase C is the same as it is possible to detect the oil properties from the aforesaid difference DC between the previous real cam phase C(n−1) and the present real cam phase C(n), and this is because the valve phase variable mechanism 50 as a device for changing a cam phase is operated by pressure of oil, and its behavior is dependent on the oil properties such as the viscosity of an oil, etc.

The significance of the steps S136 and S138 is the same as at step S135, and since a course of changes of the target cam phase CM is various as mentioned above, if the deviation DM at a specific period of time is not utilized when a small change of the target cam phase CM occurs, it is impossible to detect accurate oil properties.

When the set time of fourth timer T4 is not up at step S136, and after it is judged, at step S138, that the set time elapses with a fifth timer T5 and a set time is set to the fifth timer T5 at step S140, the flow proceeds to step S2. Incidentally, the set time to be set to the fourth timer T4 and the fifth timer T5 is occasionally set from the viewpoint of accurate oil properties detection.

When it is judged, at step S134, that the target cam phase CM does not change, it is judged, at step S141, whether or not the absolute value of the deviation DM between the real cam phase C and the target cam phase CM is smaller than a valve equivalent to 2° in crank angle, i.e., it is judged whether or not the real cam phase C converges into the target cam phase CM. If it is judged, at step S141, that the real cam converges, it is judged, at step S142, whether or not the set time of a sixth timer T6 is up with the elapse of the set time, e.g., 0.5 sec. and when the set time has not elapsed, the flow proceeds to step S132. This set time is a latency when the real cam phase C coincides with the target cam phase CM from the proximity of the target cam phase CM and the spool 92 of the linear solenoid valve 90 reaches a neutral position.

When it is judged, at step S142, that the set time of the sixth timer T6 is up, it is judged that the cam phase, i.e., a phase of the suction valve 11, is equal to the target cam phase CM to be constant, and after a set time is set to the sixth timer T6 at step S143, based on the duty ratio of the linear solenoid valve 90 when the spool 92 is at a neutral position at step S144, a delay time is acquired with reference to a map illustrating a relationship between the delay time and the duty ratio as shown in FIG. 17. A means for acquiring the delay time at step S144 is a delay time setting means. Incidentally, two types of map are prepared for use in the aforesaid steps S25 and S32, respectively, and are stored in a memory of the electronic control unit 76.

When it is judged, at step S141, that the real cam phase C does not converge into the target cam phase CM, it is judged, at step S146, whether or not the set time elapses with a seventh timer T7, and when the time elapses, after a set time is set to the seventh timer T7 at step S146, process proceeds to step S147. When the set time has not elapsed with an eighth timer T8 at step S147, the flow proceeds to step S139, and the delay time is acquired based on the deviation DM. Incidentally, the significance of both steps S145 and S147 is the same as both steps S136 and S138. Furthermore, the set times to be set to the seventh timer T7 and the eighth timer T8 are occasionally set from the viewpoint of an accurate oil properties detection.

When the set time of the sixth timer T6 is not up at step S145, and after it is judged, at step S147, that the time of the eighth timer T8 has elapsed and a set time is set to the eighth timer T8 at step S148, the flow proceeds to step S132.

Also in a flowchart of the valve operating characteristics by the second connection changing mechanism 31 and the changing routine of both the maps of fuel injection quantity and ignition timing as shown in FIG. 11, a next routine is also used as a delay time setting routine at respective steps S49 and S56 for setting the delay time to be set to respective changing delay timers TM2 and TH. In the set range of the engine speed Ne at step S133 in the flowchart of a routine for setting the delay time of the aforesaid first connection changing mechanism 30, the lowermost value Ne5 is changed to 4000 rpm and the uppermost value Ne6 is changed to 6000 rpm, respectively, with the other steps remaining the same.

In this connection, the same routine as that for setting the delay time of the valve characteristics changing mechanism 13 at the suction valves 11 side is used in case of setting the delay time of the valve characteristics changing mechanism 13 at the side of the exhaust valves 12.

Also in the second embodiment, the same effects as in the first embodiment can be obtained.

According to both the embodiments, an oil pressure changing valve is constituted by oil pressure responsive valves 80 and 81 provided with a spool 83 which is driven by a solenoid valve 85 for opening and closing a pilot oil passage 86 and a pilot pressure, but the spool 83 may be driven by a solenoid without using a solenoid valve 85 and the pilot oil passage 86, and in the case, an oil pressure switch 88 can be omitted.

According to both the embodiments, at the time of a low-speed rotation of the engine, the one suction valve 11 is substantially stalled to close the valve, and an upheaved portion 17 may be formed by a low-speed cam so that the suction valve 11 is not stalled and an opening and closing drive is made at a small lift quantity and during a slightly opening valve period. In this case, the lift quantity and the opening valve period of the low-speed cam may be the same as the cam for low speed 15, or may be different therefrom.

According to both the embodiments, the valve phase variable mechanism 50 is provided in the suction cam shaft 6, but the valve phase variable mechanism 50 may be provided in the exhaust cam shaft 7 instead of the suction cam shaft 6. Furthermore, a valve system may not be provided with two cam shafts of the suction cam shaft 6 and the exhaust cam shaft 7, and may be provided with one cam shaft comprising a suction cam and an exhaust cam.

According to both the embodiments, the oil properties are detected from behaviors of the valve phase variable mechanism 50 and the linear solenoid valve 90, but by use of a sensor for directly detecting the oil properties, the delay time can be set based on the detection results.

What is claimed is:

1. A control device of an internal combustion engine, comprising;

an operational condition detecting means for detecting an operational condition of the internal combustion engine;

a valve moving apparatus provided with a first valve control mechanism having a hydraulic valve characteristic changing mechanism for changing valve operation characteristic of at least one of a suction valve and an exhaust valve of said engine, and an oil pressure changing valve for changing pressure of a working oil supplied to said valve characteristic changing mechanism from an oil pressure source;

a first valve operation control means for controlling operation of said oil pressure changing valve in accordance with the operational condition detected by said operational condition detecting means;

control amount holding means corresponding to said respective valve operation characteristic with hold control amounts to control combustion condition of said engine;

a combustion control means operated based on said control amount of said control amount holding means;

a working oil property detecting means for detecting property of said working oil;

a holding time setting means for setting a delay time between change of oil pressure by said oil pressure changing valve and completion of change of valve operation characteristic by said valve characteristic changing mechanism based on property of said working oil detected by said working oil property detecting means and;

changing means for changing said control amount holding means to a control amount holding means corresponding to a changed valve operation characteristic when said delay time elapses after said oil pressure to be supplied to said valve characteristic changing mechanism is changed by said oil pressure changing valve.

2. A control device of an internal combustion engine as claimed in claim 1, wherein said valve moving apparatus further comprises a hydraulic valve phase variable mechanism for altering phase of open-close period of at least one of said suction valve and said exhaust valve, and a second valve control mechanism having an oil pressure control valve for controlling pressure of a working oil supplied to said valve phase variable mechanism from said oil pressure source; operation of said oil control valve is controlled by a second valve operation control means in accordance with the operational condition detected by said operational condition detecting means; and said working oil based on behavior of said second valve control mechanism.

3. A control device of an internal combustion engine as claimed in claim 2, wherein phase detecting means for detecting phase of at least one of said suction valve and said exhaust valve having phase altered, and phase change speed calculating means for calculating means for calculating changing speed of phase detected by said phase detecting means, are provided; and said working oil property detecting means detects said working oil property based on said changing speed of phase.

4. A control device of an internal combustion engine as claimed in claim 2, wherein phase detecting means for detecting phase of at least one of said suction valve and said exhaust valve having phase altered, and target phase setting means for setting a target phase based on an the operational condition detected by said operational condition detecting means are provided; said second valve operation control means controls operation of said oil pressure control valve so that said target phase concurs with said phase detected by said phase detecting means; and said working oil property detecting means detects working oil property based on deviation between said target phase and said phase detected by said phase detecting means.

5. A control device of an internal combustion engine as claimed in claim 2, wherein said oil pressure control valve is operated in accordance with an amount of supply electric current which is duty-controlled by said second valve operation control means, and said working oil property detection means detected working oil property based on duty ratio of said amount of supply election current when said valve phase variable mechanism maintains fixed phase by said oil pressure controlled by said oil pressure control valve.

* * * * *